US009039516B2

(12) United States Patent
Parrott

(10) Patent No.: US 9,039,516 B2
(45) Date of Patent: May 26, 2015

(54) CONCURRENT PLAY ON MULTIPLE GAMING MACHINES

(75) Inventor: Gregory H. Parrott, Reno, NV (US)

(73) Assignee: IGT, Las Vegas, NV (US)

( * ) Notice: Subject to any disclaimer, the term of this patent is extended or adjusted under 35 U.S.C. 154(b) by 1421 days.

(21) Appl. No.: 12/512,931

(22) Filed: Jul. 30, 2009

(65) Prior Publication Data

US 2011/0028205 A1 Feb. 3, 2011

(51) Int. Cl.
*G07F 17/32* (2006.01)

(52) U.S. Cl.
CPC ..... *G07F 17/3223* (2013.01); *G07F 17/32* (2013.01); *G07F 17/3239* (2013.01)

(58) Field of Classification Search
CPC ..... A63F 9/24; A63F 13/00; G07F 17/32; G07F 17/323; G07F 17/3262; G07F 17/3211
USPC ..... 463/25, 42
See application file for complete search history.

(56) References Cited

U.S. PATENT DOCUMENTS

| | | | |
|---|---|---|---|
| 4,335,809 | A | 6/1982 | Wain |
| 4,572,509 | A | 2/1986 | Sitrick |
| 4,652,998 | A | 3/1987 | Koza et al. |
| 4,842,278 | A | 6/1989 | Markowicz |
| 4,856,787 | A | 8/1989 | Itkis |
| 4,866,515 | A | 9/1989 | Tagawa et al. |
| 4,924,378 | A | 5/1990 | Hershey et al. |
| 5,138,712 | A | 8/1992 | Corbin |
| 5,142,622 | A | 8/1992 | Owens |
| 5,178,395 | A | 1/1993 | Lovell |
| 5,179,517 | A | 1/1993 | Sarbin et al. |
| 5,276,312 | A | 1/1994 | McCarthy |
| 5,288,978 | A | 2/1994 | Iijima |
| 5,305,195 | A | 4/1994 | Murphy |
| 5,344,144 | A | 9/1994 | Canon |
| 5,349,642 | A | 9/1994 | Kingdon |

(Continued)

FOREIGN PATENT DOCUMENTS

| | | |
|---|---|---|
| EP | 0 655 265 | 5/1995 |
| EP | 0843272 | 5/1998 |

(Continued)

OTHER PUBLICATIONS

Bally Live-Server Based Gaming brochure, written by Bally Gaming Systems, published in 2006.

(Continued)

*Primary Examiner* — David L Lewis
*Assistant Examiner* — Shauna-Kay Hall
(74) *Attorney, Agent, or Firm* — Neal, Gerber & Eisenberg LLP

(57) ABSTRACT

Some implementations allow a player to control multiple gaming machines involved in a concurrent gaming session by interacting with only one of the machines. For example, a patron may be able to provide credit and/or user input for all gaming machines that are involved in a concurrent gaming session by interacting with only one gaming machine. A patron may be able to provide a player tracking card to only one gaming machine, but may obtain player loyalty points for all participating machines. A coordinated game presentation may be provided for some or all of the gaming machines. Game outcomes of two or more gaming machines may be combined to produce an outcome that could not be produced by an individual gaming machine.

53 Claims, 19 Drawing Sheets

(56) References Cited

U.S. PATENT DOCUMENTS 5,375,206 A 12/1994 Hunter et al.
5,377,993 A 1/1995 Josephs
5,393,057 A 2/1995 Marnell, II
5,404,567 A 4/1995 DePietro et al.
5,429,361 A 7/1995 Raven et al.
5,430,791 A 7/1995 Feit et al.
5,438,508 A 8/1995 Wyman
5,465,082 A 11/1995 Weingardt
5,499,340 A 3/1996 Barritz
5,507,491 A 4/1996 Gatto et al.
5,511,781 A 4/1996 Wood et al.
5,530,232 A 6/1996 Taylor
5,531,448 A 7/1996 Moody
5,559,313 A 9/1996 Claus et al.
5,560,603 A 10/1996 Seelig et al.
5,564,700 A 10/1996 Celona
5,566,337 A 10/1996 Szymanski et al.
5,578,808 A 11/1996 Taylor
5,586,257 A 12/1996 Perlman
5,586,937 A 12/1996 Menashe
5,617,331 A 4/1997 Wakai et al.
5,626,341 A 5/1997 Jones et al.
5,630,757 A 5/1997 Gagin et al.
5,640,192 A 6/1997 Garfinkle
5,643,086 A 7/1997 Alcorn et al.
5,649,118 A 7/1997 Carlisle et al.
5,655,603 A 8/1997 Schulte et al.
5,655,961 A 8/1997 Acres et al.
5,664,998 A 9/1997 Seelig et al.
5,671,412 A 9/1997 Christiano
5,702,304 A 12/1997 Acres et al.
5,708,709 A 1/1998 Rose
5,717,604 A 2/1998 Wiggins
5,732,950 A 3/1998 Moody
5,741,183 A 4/1998 Acres et al.
5,745,879 A 4/1998 Wyman
5,752,882 A 5/1998 Acres et al.
5,755,621 A 5/1998 Marks et al.
5,758,069 A 5/1998 Olsen
5,759,102 A 6/1998 Pease et al.
5,762,552 A 6/1998 Vuong et al.
5,766,076 A 6/1998 Pease et al.
5,768,382 A 6/1998 Schneier et al.
5,779,545 A 7/1998 Berg et al.
5,779,549 A 7/1998 Walker et al.
5,788,573 A 8/1998 Baerlocher et al.
5,800,268 A 9/1998 Molnick
5,806,855 A 9/1998 Cherry
5,820,459 A 10/1998 Acres et al.
5,823,873 A 10/1998 Moody
5,828,840 A 10/1998 Cowan et al.
5,833,540 A 11/1998 Miodunski et al.
5,836,817 A 11/1998 Acres et al.
5,845,283 A 12/1998 Williams et al.
5,851,011 A 12/1998 Loff
5,851,149 A 12/1998 Xidos et al.
5,855,515 A 1/1999 Pease et al.
5,871,398 A 2/1999 Schneier et al.
5,876,284 A 3/1999 Acres et al.
5,885,158 A 3/1999 Torango et al.
5,890,962 A 4/1999 Takemoto
5,903,732 A 5/1999 Reed et al.
5,905,248 A 5/1999 Russell et al.
5,913,164 A 6/1999 Pawa et al.
5,917,725 A 6/1999 Thacher et al.
5,918,039 A 6/1999 Buswell et al.
5,925,127 A 7/1999 Ahmad
5,941,773 A 8/1999 Harlick
5,947,820 A 9/1999 Morro et al.
5,947,822 A 9/1999 Weiss
5,951,397 A 9/1999 Dickinson
5,951,611 A 9/1999 La Pierre
5,971,271 A 10/1999 Wynn et al.
5,971,849 A 10/1999 Falciglia
5,974,409 A 10/1999 Sanu et al.
5,980,093 A 11/1999 Jones et al.
5,983,190 A 11/1999 Trower, II et al.
5,991,760 A 11/1999 Gauvin et al.
5,991,790 A 11/1999 Shah et al.
5,996,068 A 11/1999 Dwyer, III et al.
5,999,808 A 12/1999 La Due
6,001,016 A 12/1999 Walker et al.
6,003,066 A 12/1999 Ryan et al.
6,003,094 A 12/1999 Dean
6,003,123 A 12/1999 Carter et al.
6,011,850 A 1/2000 Bertrand et al.
6,024,640 A 2/2000 Walker et al.
6,033,307 A * 3/2000 Vancura ..... 463/20
6,068,552 A 5/2000 Walker et al.
6,068,982 A 5/2000 Rolfe et al.
6,071,190 A 6/2000 Weiss et al.
6,079,711 A 6/2000 Wei et al.
6,085,247 A 7/2000 Parsons, Jr. et al.
6,089,975 A 7/2000 Dunn
6,089,982 A 7/2000 Holch et al.
6,099,408 A 8/2000 Schneier et al.
6,106,396 A 8/2000 Alcorn et al.
6,108,420 A 8/2000 Larose et al.
6,110,041 A 8/2000 Walker et al.
6,113,098 A 9/2000 Adams
6,113,495 A 9/2000 Walker et al.
6,117,013 A 9/2000 Eiba
6,135,884 A 10/2000 Hendrick et al.
6,135,887 A 10/2000 Pease et al.
6,141,737 A 10/2000 Krantz et al.
6,142,872 A 11/2000 Walker et al.
6,149,522 A 11/2000 Alcorn et al.
6,151,707 A 11/2000 Hecksel et al.
6,159,095 A 12/2000 Frohm et al.
6,162,122 A 12/2000 Acres et al.
6,168,520 B1 1/2001 Baerlocher et al.
6,203,428 B1 3/2001 Giobbi et al.
6,206,782 B1 3/2001 Walker et al.
6,219,836 B1 4/2001 Wells et al.
6,224,486 B1 5/2001 Walker et al.
6,234,896 B1 5/2001 Walker et al.
6,241,608 B1 6/2001 Torango
6,251,014 B1 6/2001 Stockdale et al.
6,254,483 B1 7/2001 Acres
6,257,981 B1 7/2001 Acres et al.
6,264,561 B1 7/2001 Saffari et al.
6,287,200 B1 9/2001 Sharma
6,287,202 B1 9/2001 Pascal et al.
6,293,866 B1 9/2001 Walker et al.
6,304,905 B1 10/2001 Clark
6,308,271 B2 10/2001 Tanaka
6,312,332 B1 11/2001 Walker et al.
6,312,333 B1 11/2001 Acres
6,319,122 B1 11/2001 Packes, Jr. et al.
6,319,125 B1 11/2001 Acres
6,345,386 B1 2/2002 Delo et al.
6,353,928 B1 3/2002 Altberg et al.
6,354,946 B1 3/2002 Finn
6,358,150 B1 3/2002 Mir et al.
6,361,437 B1 3/2002 Walker et al.
6,361,441 B1 * 3/2002 Walker et al. ..... 463/42
6,364,314 B1 4/2002 Canterbury
6,368,216 B1 4/2002 Hedrick et al.
6,383,074 B1 5/2002 Boggs
6,389,538 B1 5/2002 Gruse et al.
6,389,589 B1 5/2002 Mishra et al.
6,394,902 B1 5/2002 Glavich et al.
6,394,907 B1 5/2002 Rowe
6,397,381 B1 5/2002 Delo et al.
6,398,645 B1 6/2002 Yoseloff
6,402,614 B1 6/2002 Schneier et al.
6,409,602 B1 6/2002 Wiltshire et al.
6,418,554 B1 7/2002 Delo et al.
6,425,828 B2 7/2002 Walker et al.
6,427,227 B1 7/2002 Chamberlain
6,439,996 B2 8/2002 LeMay et al.
6,442,529 B1 8/2002 Krishan et al.
6,443,839 B2 9/2002 Stockdale et al.
6,450,887 B1 9/2002 Mir et al.

(56) References Cited

U.S. PATENT DOCUMENTS 6,457,175 B1 9/2002 Lerche
RE37,885 E 10/2002 Acres et al.
6,488,585 B1 12/2002 Wells et al.
6,503,146 B2 1/2003 Walker et al.
6,503,147 B1 1/2003 Stockdale et al.
6,508,710 B1 1/2003 Paravia et al.
6,511,068 B1 1/2003 Sklansky et al.
6,523,166 B1 2/2003 Mishra et al.
6,527,638 B1 3/2003 Walker et al.
6,532,543 B1 3/2003 Smith et al.
6,533,664 B1 3/2003 Crumby
6,565,434 B1 5/2003 Acres
6,575,832 B1 6/2003 Manfredi et al.
6,578,199 B1 6/2003 Tsou et al.
6,592,457 B1 7/2003 Frohm et al.
6,595,856 B1 7/2003 Ginsburg et al.
6,607,439 B2 8/2003 Schneier et al.
6,609,978 B1 8/2003 Paulsen
6,620,047 B1 9/2003 Alcorn et al.
6,628,939 B2 9/2003 Paulsen
6,638,170 B1 10/2003 Crumby
6,645,077 B2 11/2003 Rowe
6,648,758 B2 11/2003 Bennett et al.
6,652,378 B2 11/2003 Cannon et al.
6,656,040 B1 12/2003 Brosnan et al.
6,656,044 B1 12/2003 Lewis
6,682,423 B2 1/2004 Brosnan et al.
6,685,567 B2 2/2004 Cockerille et al.
6,695,696 B1 2/2004 Kaminkow
6,712,699 B2 3/2004 Walker et al.
6,712,702 B2 3/2004 Goldberg et al.
6,722,986 B1 4/2004 Lyons et al.
6,733,390 B2 5/2004 Walker et al.
6,746,327 B2 6/2004 Frohm et al.
6,749,510 B2 6/2004 Giobbi
6,780,111 B2 8/2004 Cannon et al.
6,782,477 B2 8/2004 McCarroll
6,786,819 B2 9/2004 Baerlocher et al.
6,790,142 B2 9/2004 Okada et al.
6,790,143 B2 9/2004 Crumby
6,802,778 B1 10/2004 LeMay et al.
6,804,763 B1 10/2004 Stockdale et al.
6,805,634 B1 10/2004 Wells et al.
6,811,488 B2 11/2004 Paravia et al.
6,813,765 B1 11/2004 Flores
6,816,882 B1 11/2004 Conner et al.
6,823,456 B1 11/2004 Dan et al.
6,830,515 B2 12/2004 Rowe
6,832,958 B2 12/2004 Acres et al.
6,834,245 B2 12/2004 Ota et al.
6,836,794 B1 12/2004 Lucovsky et al.
6,837,793 B2 1/2005 McClintic
6,843,723 B2 1/2005 Joshi
6,843,725 B2 1/2005 Nelson
6,846,238 B2 1/2005 Wells
6,852,031 B1 2/2005 Rowe
6,855,054 B2 2/2005 White et al.
6,855,057 B2 2/2005 Namba et al.
6,857,959 B1 2/2005 Nguyen
6,860,810 B2 3/2005 Cannon et al.
6,863,608 B1 3/2005 LeMay et al.
6,866,581 B2 3/2005 Martinek et al.
6,866,584 B2 3/2005 Michaelson
6,866,586 B2 3/2005 Oberberger et al.
6,875,109 B2 4/2005 Stockdale
6,875,110 B1 4/2005 Crumby
6,878,063 B2 4/2005 Manfredi et al.
6,884,162 B2 4/2005 Raverdy et al.
6,884,166 B2 4/2005 Leen et al.
6,884,170 B2 4/2005 Rowe
6,884,171 B2 4/2005 Eck et al.
6,884,173 B2 4/2005 Gauselmann
6,884,174 B2 4/2005 Lundy et al.
6,887,151 B2 5/2005 Leen et al.
6,887,156 B2 5/2005 DeWeese et al.
6,889,159 B2 5/2005 Klotz et al.
6,890,256 B2 5/2005 Walker et al.
6,896,616 B2 5/2005 Weiss
6,896,618 B2 5/2005 Benoy et al.
6,899,627 B2 5/2005 Lam et al.
6,899,628 B2 5/2005 Leen et al.
6,901,375 B2 5/2005 Fernandez
6,902,478 B2 6/2005 McClintic
6,902,481 B2 6/2005 Breckner et al.
6,908,390 B2 6/2005 Nguyen et al.
6,908,391 B2 6/2005 Gatto et al.
6,910,965 B2 6/2005 Downes
6,923,720 B2 8/2005 Loose
6,939,226 B1 9/2005 Joshi
6,939,234 B2 9/2005 Beatty
6,942,571 B1 9/2005 McAllister et al.
6,945,870 B2 9/2005 Gatto et al.
6,960,136 B2 11/2005 Joshi et al.
6,991,544 B2 1/2006 Soltys et al.
7,051,004 B2 5/2006 Nuttall et al.
7,066,815 B2 6/2006 Walker et al.
7,105,736 B2 9/2006 Laakso
7,156,741 B2 1/2007 Hornik et al.
7,355,112 B2 4/2008 Laakso
7,360,761 B2 4/2008 Durham et al.
8,147,322 B2 * 4/2012 Walker et al. ..... 463/25
2001/0036857 A1 11/2001 Mothwurf et al.
2001/0044337 A1 11/2001 Rowe et al.
2001/0046893 A1 11/2001 Giobbi et al.
2001/0055990 A1 12/2001 Acres
2002/0032049 A1 3/2002 Walker et al.
2002/0045474 A1 4/2002 Singer et al.
2002/0045484 A1 4/2002 Eck et al.
2002/0057800 A1 5/2002 Gordon et al.
2002/0058546 A2 5/2002 Acres
2002/0068629 A1 6/2002 Allen et al.
2002/0068631 A1 6/2002 Raverdy et al.
2002/0071557 A1 6/2002 Nguyen
2002/0071560 A1 6/2002 Kurn et al.
2002/0080969 A1 6/2002 Giobbi
2002/0111209 A1 8/2002 Walker et al.
2002/0116615 A1 8/2002 Nguyen et al.
2002/0137217 A1 9/2002 Rowe
2002/0138594 A1 9/2002 Rowe
2002/0144116 A1 10/2002 Giobbi
2002/0151358 A1 * 10/2002 Walker et al. ..... 463/25
2002/0151360 A1 10/2002 Durham et al.
2002/0151363 A1 10/2002 Letovsky et al.
2002/0160826 A1 10/2002 Gomez et al.
2002/0169022 A1 11/2002 Canterbury
2002/0173355 A1 11/2002 Walker et al.
2002/0174160 A1 11/2002 Gatto et al.
2002/0174444 A1 11/2002 Gatto et al.
2002/0177483 A1 11/2002 Cannon
2002/0183105 A1 12/2002 Cannon et al.
2002/0188940 A1 12/2002 Breckner et al.
2003/0027638 A1 2/2003 Schneider et al.
2003/0032474 A1 * 2/2003 Kaminkow ..... 463/25
2003/0036430 A1 2/2003 Cannon
2003/0045351 A1 3/2003 Gauselmann
2003/0045354 A1 3/2003 Giobbi
2003/0054879 A1 3/2003 Schneier et al.
2003/0060268 A1 3/2003 Falconer
2003/0060286 A1 3/2003 Walker et al.
2003/0064771 A1 4/2003 Morrow et al.
2003/0064807 A1 4/2003 Walker et al.
2003/0069058 A1 4/2003 Byrne et al.
2003/0073497 A1 4/2003 Nelson
2003/0078093 A1 4/2003 Simms et al.
2003/0078094 A1 4/2003 Gatto et al.
2003/0078101 A1 4/2003 Schneider et al.
2003/0092489 A1 5/2003 Veradej
2003/0093669 A1 5/2003 Morais et al.
2003/0100359 A1 5/2003 Loose et al.
2003/0100369 A1 5/2003 Gatto et al.
2003/0100370 A1 5/2003 Gatto et al.
2003/0100371 A1 5/2003 Gatto et al.
2003/0100372 A1 5/2003 Gatto et al.
2003/0104865 A1 6/2003 Itkis et al.

(56) References Cited

U.S. PATENT DOCUMENTS

2003/0114218 A1 6/2003 McClintic
2003/0114219 A1 6/2003 McClintic
2003/0115351 A1 6/2003 Giobbi
2003/0125107 A1 7/2003 Cannon
2003/0139214 A1 7/2003 Wolf et al.
2003/0140134 A1 7/2003 Swanson et al.
2003/0162583 A1 8/2003 Baerlocher et al.
2003/0162589 A1 8/2003 Nguyen et al.
2003/0171149 A1 9/2003 Rothschild
2003/0176219 A1 9/2003 Manfredi et al.
2003/0181231 A1 9/2003 Vancura et al.
2003/0186745 A1 10/2003 Nguyen et al.
2003/0188306 A1 10/2003 Harris et al.
2003/0190941 A1 10/2003 Byrne
2003/0195033 A1 10/2003 Gazdic et al.
2003/0216182 A1 11/2003 Gauselmann
2003/0224852 A1* 12/2003 Walker et al. ..... 463/20
2003/0228904 A1 12/2003 Acres et al.
2003/0228907 A1 12/2003 Gatto et al.
2003/0228912 A1 12/2003 Wells et al.
2003/0232650 A1 12/2003 Beatty
2004/0002381 A1 1/2004 Alcorn et al.
2004/0002385 A1 1/2004 Nguyen
2004/0003389 A1 1/2004 Reynar et al.
2004/0005919 A1 1/2004 Walker et al.
2004/0010700 A1 1/2004 Mont
2004/0015423 A1 1/2004 Walker et al.
2004/0023721 A1 2/2004 Giobbi
2004/0024666 A1 2/2004 Walker et al.
2004/0029635 A1 2/2004 Giobbi
2004/0038723 A1 2/2004 Schneier et al.
2004/0048660 A1 3/2004 Gentles et al.
2004/0048667 A1 3/2004 Rowe
2004/0053664 A1 3/2004 Byrne
2004/0054952 A1 3/2004 Morrow et al.
2004/0063489 A1 4/2004 Crumby
2004/0072604 A1 4/2004 Toyoda
2004/0072608 A1 4/2004 Toyoda
2004/0072619 A1* 4/2004 Brosnan et al. ..... 463/42
2004/0082385 A1 4/2004 Silva et al.
2004/0092310 A1 5/2004 Brosnan et al.
2004/0098597 A1 5/2004 Giobbi
2004/0106446 A1 6/2004 Cannon et al.
2004/0106452 A1 6/2004 Nguyen et al.
2004/0124243 A1 7/2004 Gatto et al.
2004/0127279 A1 7/2004 Gatto et al.
2004/0132532 A1 7/2004 Brosnan et al.
2004/0133485 A1 7/2004 Schoonmaker et al.
2004/0142739 A1 7/2004 Loose et al.
2004/0142742 A1 7/2004 Schneider et al.
2004/0152509 A1* 8/2004 Hornik et al. ..... 463/20
2004/0162144 A1 8/2004 Loose et al.
2004/0166923 A1 8/2004 Michaelson et al.
2004/0166940 A1 8/2004 Rothschild
2004/0166942 A1 8/2004 Muir
2004/0176162 A1 9/2004 Rothschild
2004/0176167 A1 9/2004 Michaelson et al.
2004/0179701 A1 9/2004 Boyd
2004/0180721 A1 9/2004 Rowe
2004/0180722 A1 9/2004 Giobbi
2004/0185936 A1 9/2004 Block et al.
2004/0193726 A1 9/2004 Gatto et al.
2004/0198494 A1 10/2004 Nguyen et al.
2004/0198496 A1 10/2004 Gatto et al.
2004/0204232 A1 10/2004 Asher et al.
2004/0204244 A1 10/2004 Rathsack et al.
2004/0214622 A1 10/2004 Atkinson
2004/0214627 A1 10/2004 Jordan et al.
2004/0214640 A1 10/2004 Giobbi
2004/0214641 A1 10/2004 Giobbi
2004/0215756 A1 10/2004 VanAntwerp et al.
2004/0219967 A1 11/2004 Giobbi et al.
2004/0219983 A1 11/2004 Giobbi
2004/0224770 A1 11/2004 Wolf et al.
2004/0229684 A1 11/2004 Blackburn et al.
2004/0229698 A1 11/2004 Lind et al.
2004/0229699 A1 11/2004 Gentles et al.
2004/0235559 A1 11/2004 Brosnan et al.
2004/0235563 A1 11/2004 Blackburn et al.
2004/0242298 A1 12/2004 Inamura et al.
2004/0242303 A1 12/2004 Walker et al.
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248642 A1 12/2004 Rothschild
2004/0248645 A1 12/2004 Blackburn et al.
2004/0248646 A1 12/2004 Canterbury
2004/0248651 A1 12/2004 Gagner
2004/0254006 A1 12/2004 Lam et al.
2004/0254013 A1 12/2004 Quraishi et al.
2004/0254014 A1 12/2004 Quraishi et al.
2004/0254954 A1 12/2004 Gatto et al.
2004/0255139 A1 12/2004 Giobbi
2004/0259629 A1 12/2004 Michaelson et al.
2004/0259633 A1 12/2004 Gentles et al.
2004/0259640 A1 12/2004 Gentles et al.
2004/0259643 A1 12/2004 Gentles
2004/0266532 A1 12/2004 Blackburn et al.
2004/0266533 A1 12/2004 Gentles et al.
2005/0003886 A1 1/2005 Englman et al.
2005/0009599 A1 1/2005 Ryan
2005/0009601 A1 1/2005 Manfredi et al.
2005/0009607 A1 1/2005 Russell et al.
2005/0010738 A1 1/2005 Stockdale et al.
2005/0014559 A1 1/2005 Mattice et al.
2005/0032566 A1 2/2005 Baerlocher et al.
2005/0032573 A1 2/2005 Acres et al.
2005/0032577 A1 2/2005 Blackburn et al.
2005/0037708 A1 2/2005 Torvinen
2005/0043072 A1 2/2005 Nelson
2005/0043088 A1 2/2005 Nguyen et al.
2005/0043090 A1 2/2005 Pryzby et al.
2005/0043094 A1 2/2005 Nguyen et al.
2005/0044535 A1 2/2005 Copper
2005/0049037 A1 3/2005 Anderson et al.
2005/0054431 A1 3/2005 Walker et al.
2005/0054438 A1 3/2005 Rothschild et al.
2005/0054440 A1 3/2005 Anderson et al.
2005/0054445 A1 3/2005 Gatto et al.
2005/0054447 A1 3/2005 Hiroyama et al.
2005/0054448 A1 3/2005 Frerking et al.
2005/0059457 A1 3/2005 Rothschild et al.
2005/0059493 A1 3/2005 Tyson et al.
2005/0059494 A1 3/2005 Kammler
2005/0064939 A1 3/2005 McSheffrey et al.
2005/0075983 A1 4/2005 St. Denis
2005/0081623 A1 4/2005 Frank
2005/0086286 A1 4/2005 Gatto et al.
2005/0090313 A1 4/2005 Rowe
2005/0096114 A1 5/2005 Cannon et al.
2005/0096133 A1 5/2005 Hoefelmeyer et al.
2005/0097342 A1 5/2005 Gatto et al.
2005/0101370 A1 5/2005 Lind et al.
2005/0107164 A1 5/2005 Muir et al.
2005/0113172 A1 5/2005 Gong
2005/0114272 A1 5/2005 Herrmann et al.
2005/0119045 A1 6/2005 Fujimoto
2005/0119046 A1 6/2005 Fujimoto
2005/0137012 A1 6/2005 Michaealson
2005/0148385 A1 7/2005 Michaealson
2005/0181860 A1 8/2005 Nguyen et al.
2005/0193209 A1 9/2005 Saunders et al.
2005/0221882 A1 10/2005 Nguyen et al.
2005/0233794 A1 10/2005 Cannon et al.
2005/0261060 A1 11/2005 Nguyen et al.
2005/0261061 A1 11/2005 Nguyen et al.
2005/0282629 A1 12/2005 Gagner
2005/0282638 A1 12/2005 Rowe
2006/0009273 A2 1/2006 Moshal
2006/0019747 A1 1/2006 Loose et al.
2006/0019750 A1 1/2006 Beatty

(56) References Cited

U.S. PATENT DOCUMENTS

| | | | | |
|---|---|---|---|---|
| 2006/0025209 | A1 | 2/2006 | Walker et al. | |
| 2006/0030409 | A1 | 2/2006 | Lechner et al. | |
| 2006/0031829 | A1 | 2/2006 | Harris et al. | |
| 2006/0036573 | A1 | 2/2006 | Watanabe et al. | |
| 2006/0039132 | A1 | 2/2006 | Chen | |
| 2006/0040735 | A1 | 2/2006 | Baerlocher | |
| 2006/0068875 | A1 | 3/2006 | Cregan et al. | |
| 2006/0073887 | A1 | 4/2006 | Nguyen et al. | |
| 2006/0084486 | A1 | 4/2006 | Belger et al. | |
| 2006/0084502 | A1 | 4/2006 | Downs, III et al. | |
| 2006/0089194 | A1 | 4/2006 | Joshi et al. | |
| 2006/0094508 | A1 | 5/2006 | D'Amico et al. | |
| 2006/0111170 | A1 | 5/2006 | Hornik et al. | |
| 2006/0121972 | A1 | 6/2006 | Walker et al. | |
| 2006/0128460 | A1 | 6/2006 | Muir et al. | |
| 2006/0135255 | A1 | 6/2006 | Roth | |
| 2006/0160614 | A1* | 7/2006 | Walker et al. | 463/29 |
| 2006/0172794 | A1* | 8/2006 | Walker et al. | 463/20 |
| 2006/0194633 | A1 | 8/2006 | Paulsen | |
| 2006/0211479 | A1 | 9/2006 | Walker et al. | |
| 2006/0211480 | A1 | 9/2006 | Walker et al. | |
| 2006/0217170 | A1 | 9/2006 | Roireau | |
| 2006/0217171 | A1 | 9/2006 | Roireau | |
| 2006/0217172 | A1 | 9/2006 | Roireau | |
| 2006/0217176 | A1 | 9/2006 | Walker et al. | |
| 2006/0223613 | A1 | 10/2006 | Walker et al. | |
| 2006/0223636 | A1 | 10/2006 | Walker et al. | |
| 2006/0240887 | A1 | 10/2006 | Walker et al. | |
| 2006/0240889 | A1 | 10/2006 | Walker et al. | |
| 2006/0240892 | A1 | 10/2006 | Walker et al. | |
| 2006/0246983 | A1 | 11/2006 | Huard et al. | |
| 2006/0247012 | A1 | 11/2006 | Walker et al. | |
| 2006/0252523 | A1 | 11/2006 | Walker et al. | |
| 2006/0258446 | A1 | 11/2006 | Nguyen et al. | |
| 2006/0287107 | A1 | 12/2006 | Okada | |
| 2007/0004509 | A1 | 1/2007 | Banton | |
| 2007/0054741 | A1 | 3/2007 | Morrow et al. | |
| 2007/0060323 | A1 | 3/2007 | Isaac et al. | |
| 2007/0135215 | A1 | 6/2007 | Walker et al. | |
| 2007/0191090 | A1* | 8/2007 | O'Halloran et al. | 463/20 |
| 2007/0232397 | A1 | 10/2007 | Katz | |
| 2008/0039175 | A1* | 2/2008 | Tessmer et al. | 463/20 |
| 2008/0318656 | A1* | 12/2008 | Walker et al. | 463/20 |
| 2009/0111574 | A1 | 4/2009 | Rowe | |
| 2009/0197659 | A1* | 8/2009 | Christensen | 463/16 |
| 2009/0325670 | A1* | 12/2009 | Kelly et al. | 463/20 |
| 2009/0325672 | A1* | 12/2009 | Kelly | 463/20 |

FOREIGN PATENT DOCUMENTS

| | | |
|---|---|---|
| EP | 1004970 | 5/2000 |
| EP | 1199690 | 2/2004 |
| EP | 0813132 | 1/2005 |
| EP | 1378873 | 3/2005 |
| EP | 1238688 | 5/2005 |
| EP | 1378874 | 5/2005 |
| EP | 1471710 | 5/2005 |
| EP | 1291048 | 6/2005 |
| EP | 1 610 275 | 12/2005 |
| WO | WO 9727570 | 7/1997 |
| WO | WO 9835309 | 8/1998 |
| WO | WO 98/56475 | 12/1998 |
| WO | WO 9910849 | 3/1999 |
| WO | WO 9941718 | 8/1999 |
| WO | WO 9965579 | 12/1999 |
| WO | WO 0025281 | 5/2000 |
| WO | WO 00/32286 | 6/2000 |
| WO | WO 0161437 | 8/2001 |
| WO | WO 0222225 | 3/2002 |
| WO | WO 02099760 | 12/2002 |
| WO | WO 03/028830 | 4/2003 |
| WO | WO 03/041825 | 5/2003 |
| WO | WO 03045515 | 6/2003 |
| WO | WO 03045516 | 6/2003 |
| WO | WO 2004004855 | 1/2004 |
| WO | WO 2004103495 | 12/2004 |
| WO | WO 2005028056 | 3/2005 |
| WO | WO 2005029220 | 3/2005 |
| WO | WO 2005033825 | 4/2005 |
| WO | WO 2005033826 | 4/2005 |
| WO | WO 2005120672 | 12/2005 |
| WO | WO 2006027677 | 3/2006 |
| WO | WO 2006039067 | 4/2006 |
| WO | WO 2007103054 | 9/2007 |

OTHER PUBLICATIONS

Bonusing Solutions without Limits brochure, written by Bally Gaming Systems, published in 2005.

SB Products—The Next Big Innovation, printed from www.igt.com in Aug. 2006.

Server Based: Other Possibilities Article; published by www.casinocenter.com in May 2006.

Transferring Gaming brochure, written by Cyberview Technology, published in 2006.

* cited by examiner

CONCURRENT PLAY ON MULTIPLE GAMING MACHINES

FIELD OF THE INVENTION

The present invention relates generally to methods and devices for providing games, such as wagering games.

BACKGROUND OF THE INVENTION

Many casino patrons enjoy simultaneously playing more than one wager gaming machine. Typically, such patrons will need to move from one wager gaming machine to another, inserting credit, making wagers, hitting the "Play" button of each machine, etc. Each wager gaming machine is typically in a different phase of play at any particular time. In some cases, if one wager gaming machine requires a player's attention for more than a few seconds, another wager gaming machine may be idle. Another patron may believe that the idle machine is available. It would be desirable to provide more versatile methods and devices for simultaneously playing more than one wager gaming machine.

SUMMARY

Methods and devices are provided for simultaneously playing more than one gaming machine, including but not limited to simultaneously playing more than one wager gaming machine. Some implementations coordinate the responses of multiple gaming machines that are involved in a concurrent gaming session. As used herein, the terms "concurrent gaming session," "concurrent play" and the like mean a gaming session involving multiple gaming machines. The terms may refer to, but are not limited to, a single-player gaming session involving multiple gaming machines. For example, a patron may be able to provide credit and/or user input for all gaming machines that are involved in a concurrent gaming session by interacting with only one gaming machine. Similarly, a patron may be able to present a player loyalty device (e.g., a player tracking card) to only one gaming machine, but still may be able to obtain player loyalty points corresponding to gaming on all gaming machines that are involved in a concurrent gaming session. The terms "player tracking" and "player loyalty" may be used synonymously herein.

Some implementations provide a coordinated game presentation involving all gaming machines that are involved in a concurrent gaming session. For example, the game outcomes on all participating gaming machines may be presented in a sequential fashion, e.g., from left to right, right to left, etc. In some implementations, coordinating the wager gaming sessions of multiple wager gaming machines involves combining a game outcome of two or more gaming machines to produce a combined wager gaming outcome that could not be produced in its entirety by an individual gaming machine.

Some embodiments described herein provide a wager gaming machine that includes the following elements: apparatus for presenting wagering games; an interface system configured for communicating with at least one other device; a user input system configured for receiving a selection from a player to use multiple wager gaming machines during a wager gaming session; and a logic system comprising at least one logic device (such as a processor, a programmable logic device, etc.).

The logic system may be configured to control the apparatus for presenting wagering games and to send an indication responsive to the received selection, via the interface system, for functionality of a second wager gaming machine to be disabled, at least in part. It should be appreciated that what is described herein with reference to a "second wager gaming machine" or the like will be generally applicable to other wager gaming machines. Accordingly, even though such functionality may not be explicitly described with regard to a third wager gaming machine, a fourth wager gaming machine, etc., it should be understood that such remarks could apply to more than one additional wager gaming machine.

For example, the responsive indication may comprise an indication to disable at least a portion of a user input system, a player tracking system, a device for receiving indicia of credit and/or a device for dispensing indicia of credit on the second wager gaming machine. The indication may comprise an indication to disable at least a portion of gaming controller functionality of the second wager gaming machine.

The selection received from the player may include at least one identified wager gaming machine. The responsive indication may be for functionality of the identified wager gaming machine to be disabled, at least in part. The logic system may be further configured to evaluate a combined wager gaming outcome by reference to a combined wager gaming outcome paytable. The combined wager gaming outcome paytable may comprise at least one combined wager gaming outcome that could not be produced in its entirety by either the identified wager gaming machine or the other wager gaming machine.

The logic system may be further configured to provide the wager gaming session by coordinating responses of the wager gaming machine and the second wager gaming machine. For example, the coordinating process may involve enabling at least one component associated with the wager gaming machine to provide functionality relating to the second wager gaming machine. The component may be, for example, a component of a value input system that is configured for receiving indicia of credit. The value input system component may be a bill acceptor, a ticket or voucher reader, etc. In some such embodiments, indicia of credit received by a value input device of the wager gaming machine may be applied to game play on the second wager gaming machine.

In some embodiments, a payout system of the wager gaming machine may be configured for dispensing indicia of credit relating to wager gaming on the wager gaming machine and/or the second wager gaming machine. The coordinating process may involve enabling a ticket printer of the wager gaming machine to print a ticket corresponding to credits associated, at least in part, with the second wager gaming machine. The coordinating process may involve controlling a device of the wager gaming machine for dispensing indicia of credit to dispense currency, coins or tokens corresponding to credits associated, at least in part, with the second wager gaming machine.

The coordinating process may involve enabling at least a portion of a user input system of the wager gaming machine to receive input relating to functionality of the second wager gaming machine. For example, the coordinating process may involve enabling a touch screen, buttons, a joystick and/or an optical imaging device of the wager gaming machine to receive input relating to functionality of the second wager gaming machine.

The coordinating process may involve enabling a reader of the wager gaming machine to provide functionality relating to the second wager gaming machine. The reader may be a magnetic card reader, a radio frequency identification tag reader, etc. For example, player loyalty data obtained via a player loyalty card reader may be associated with wager gaming on the wager gaming machine or the second wager gaming machine. A player may provide a single player loyalty card to the wager gaming machine, but may be able to receive player loyalty points relating to wagering games played on the second wager gaming machine. Accordingly, some implementations involve enabling predetermined devices of the wager gaming machine to operate as a centralized device set for a plurality of wager gaming machines.

The coordinating process may involve controlling a time interval between first images of a first game outcome displayed on the wager gaming machine and second images of a second game outcome displayed on the second wager gaming machine. The coordinating process may involve combining a first wager gaming outcome on the wager gaming machine with a second wager gaming outcome on the second wager gaming machine to produce a combined wager gaming outcome. In some such embodiments, the combined wager gaming outcome could not be produced in its entirety by either the wager gaming machine or the second wager gaming machine.

The logic system may be configured to send an indication, via the interface system, for functionality of a third wager gaming machine to be disabled, at least in part. The logic system may be further configured to provide the wager gaming session by coordinating responses of the wager gaming machine and the third wager gaming machine.

The logic system may be configured to control, at least in part, the operations of the second wager gaming machine. For example, the user input system may be configured (at least temporarily) for receiving instructions relating to the second wager gaming machine. According to some such embodiments, the user input system may comprise a display configured to present, under the control of the logic system, a graphical user interface for receiving instructions regarding the second wager gaming machine.

The interface system may comprise a network interface. The interface system may be configured for communication with the second wager gaming machine via free space optical communication. The interface system may be configured for communication with the second wager gaming machine via an industrial automation protocol. The interface system may include at least one network interface that is configured for communication with other devices, either directly or indirectly. For example, the network interface may be configured for communication with other devices via an Ethernet standard, via Transmission Control Protocol ("TCP") and/or Internet Protocol ("IP"), etc. Other examples of protocols are described herein with reference to specific embodiments.

Alternative implementations described herein involve a method that includes the following steps: receiving an indication that a player desires to use multiple wager gaming machines during a gaming session, the indication including an identified wager gaming machine; sending a command to disable at least a portion of the functionality of the identified wager gaming machine; and providing the gaming session by coordinating responses of the identified wager gaming machine and at least one other wager gaming machine.

For example, the command may comprise a command to disable at least a portion of a user input system and/or at least a portion of a player tracking system of the identified wager gaming machine. The command may comprise a command to disable a device for receiving indicia of credit for the identified wager gaming machine. The command may comprise a command to disable at least a portion of gaming controller functionality of the identified wager gaming machine.

The providing process may involve making the identified wager gaming machine operate, at least in part, under the control of another device. For example, the providing process may involve making the identified wager gaming machine operate, at least in part, under the control of a server and/or making the identified wager gaming machine operate, at least in part, under the control of a wager gaming machine.

The coordinating process may involve coordinating a display of images or sounds on the identified wager gaming machine and at least one other wager gaming machine. The coordinating process may involve controlling a time interval between first images displayed on the identified wager gaming machine and second images displayed on a second wager gaming machine. The coordinating process may involve combining player loyalty points for wager gaming on the identified wager gaming machine and player loyalty points for wager gaming on at least one other wager gaming machine.

Alternatively, or additionally, the coordinating process may involve combining a first wager gaming outcome on the identified wager gaming machine with a second wager gaming outcome on at least one other wager gaming machine to produce a combined wager gaming outcome. In some instances, the combined wager gaming outcome could not be produced in its entirety either by the identified wager gaming machine or the other wager gaming machine. The method may further involve evaluating the combined wager gaming outcome by reference to a combined wager gaming outcome paytable. The combined wager gaming outcome paytable may comprise at least one combined wager gaming outcome that could not be produced in its entirety by either the identified wager gaming machine or the other wager gaming machine.

Alternative embodiments described herein involve an apparatus that includes an interface system and a logic system. The interface system may include at least one interface (e.g., a network interface or a user interface) configured for receiving an indication that a player desires to use multiple wager gaming machines during a gaming session. In some embodiments, the interface system may be configured for communication via an industrial automation protocol.

The received indication may include an identified wager gaming machine. The logic system may be configured to provide the gaming session by coordinating responses of the identified wager gaming machine and at least one other wager gaming machine.

The logic system may be configured to send a command, via the interface system, to disable at least a portion of the functionality of the identified wager gaming machine. For example, the command may comprise an instruction to disable at least a portion of a user input system or a player tracking system of the identified wager gaming machine. The command may comprise an instruction to disable a device for receiving indicia of credit for the identified wager gaming machine. The command may comprise an instruction to disable at least a portion of gaming controller functionality of the identified wager gaming machine.

The providing process may involve controlling the identified wager gaming machine, at least in part. For example, the providing process may involve providing game outcome data to the identified wager gaming machine.

The coordinating process may involve coordinating a display of wager game outcome images on the identified wager gaming machine and at least one other wager gaming machine. The coordinating process may involve controlling a time interval between first images displayed on the identified wager gaming machine and second images displayed on a second wager gaming machine. The coordinating process may involve combining player loyalty points for wager gaming on the identified wager gaming machine and player loyalty points for wager gaming on at least one other wager gaming machine.

Alternatively, or additionally, the coordinating process may involve combining a first wager gaming outcome on the identified wager gaming machine with a second wager gaming outcome on at least one other wager gaming machine to produce a combined wager gaming outcome. In some such embodiments, the combined wager gaming outcome could not be produced in its entirety either by the identified wager gaming machine or the other wager gaming machine. The logic system may be further configured to evaluate the combined wager gaming outcome by reference to a combined wager gaming outcome paytable. The combined wager gaming outcome paytable may include at least one combined wager gaming outcome that could not be produced in its entirety either by the identified wager gaming machine or the other wager gaming machine.

In some embodiments, a server may comprise at least some elements of the apparatus. In some embodiments, a wager gaming machine may comprise at least some elements of the apparatus.

These and other methods of the invention may be implemented by various types of hardware, software, firmware, etc. For example, some features of the invention may be implemented, at least in part, by one or more stationary gaming machines, by one or more portable gaming devices and/or other type of mobile devices, by one or more host devices, servers, etc. Some embodiments of the invention are provided as computer programs embodied in machine-readable media. The computer programs may include instructions for controlling one or more devices to perform the methods described herein.

DETAILED DESCRIPTION

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, the steps of methods shown and described herein are not necessarily performed in the order indicated. It should also be understood that the methods of the invention may include more or fewer steps than are indicated.

Device functionality may be apportioned by grouping or dividing tasks in any convenient fashion. Therefore, when steps are described herein as being performed by a single device (e.g., a single server), the steps may alternatively be performed by multiple devices and vice versa.

Figure 1:
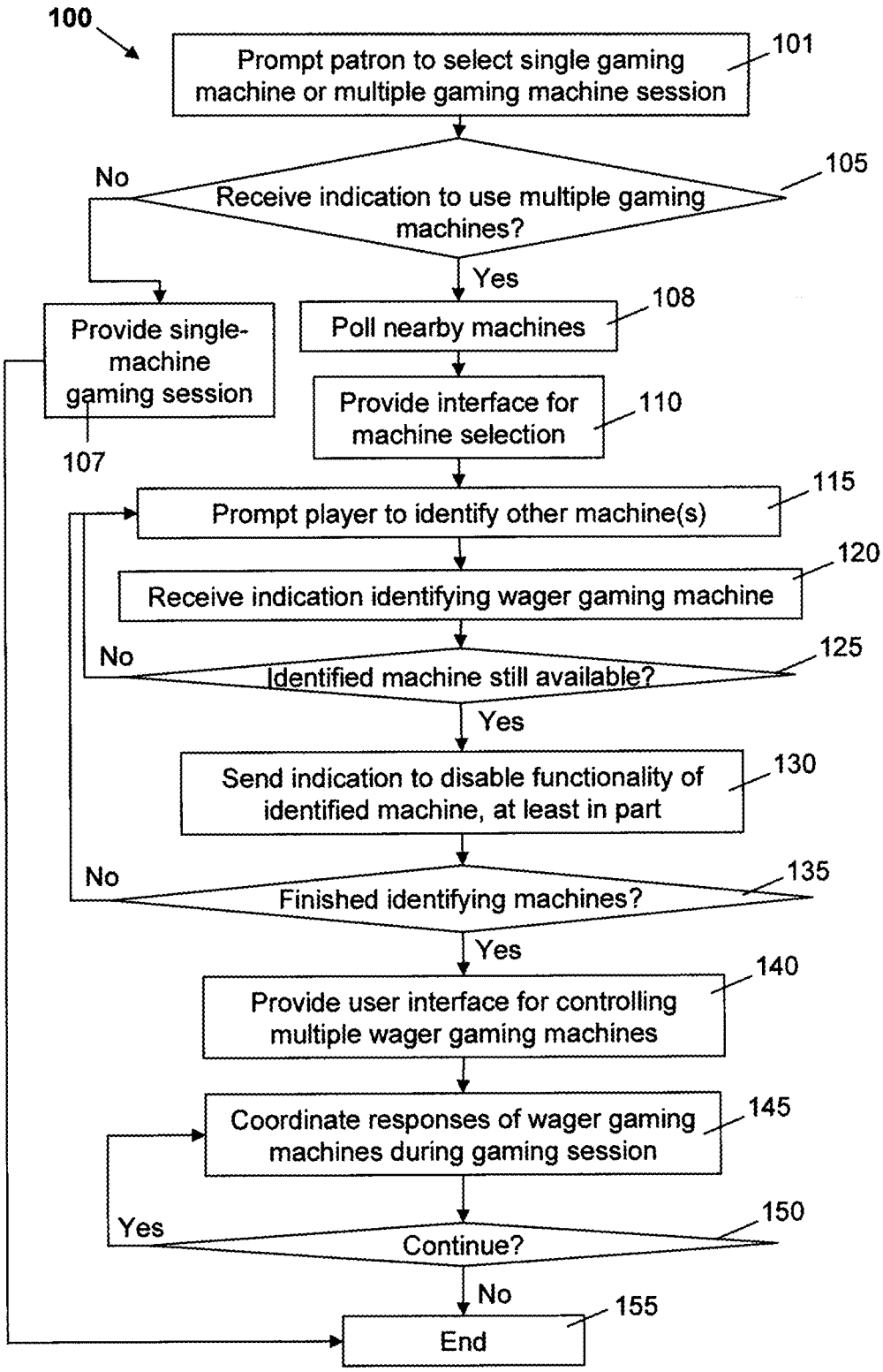
FIG. 1 is flow chart that outlines steps of various implementations.

Referring now to FIG. 1, the steps of method 100 will now be described. In some implementations of the invention, the steps of method 100 may be performed, at least in part, by a logic system of an electronic wager gaming machine. In alternative implementations, the steps of method 100 may be performed, at least in part, by one or more other devices of a casino's computer system, e.g., by one or more servers, host devices, switches, routers, mobile devices, thin terminals, etc. For example, in some implementations, some steps of method 100 may be performed by one or more devices of a central system (e.g., a server).

In some such alternative implementations, wagering games may be presented on "thin" terminals. As used herein, the terms "thin terminal," "thin client" or the like may refer broadly to client computers and/or client software that depend, at least to some extent, on one or more central devices for processing activities but which may potentially have a range of processing capabilities. As such, the term "thin client" may sometimes be used as the term is generally known in the art, but may also be used to refer to a more versatile device and/or related software, such as a diskless node or a hybrid client. In some implementations, a portion of a device (such as a line card of a network device, a blade of a blade server, etc.) may be configured to perform at least some of these steps, or other steps described herein. Examples of some such devices will be provided below.

In step 101, a player is prompted to indicate whether to have a wager gaming session on a single machine or on multiple machines. Step 101 may involve indicating that a particular wager gaming machine can be configured for simultaneous play involving other wager gaming machines. Step 101 may be performed actively (e.g., via an audio, video and/or other visual prompt) or passively (e.g., via a sign, a label, a static display, etc.). Step 101 may be omitted in some implementations.

Figure 2A:
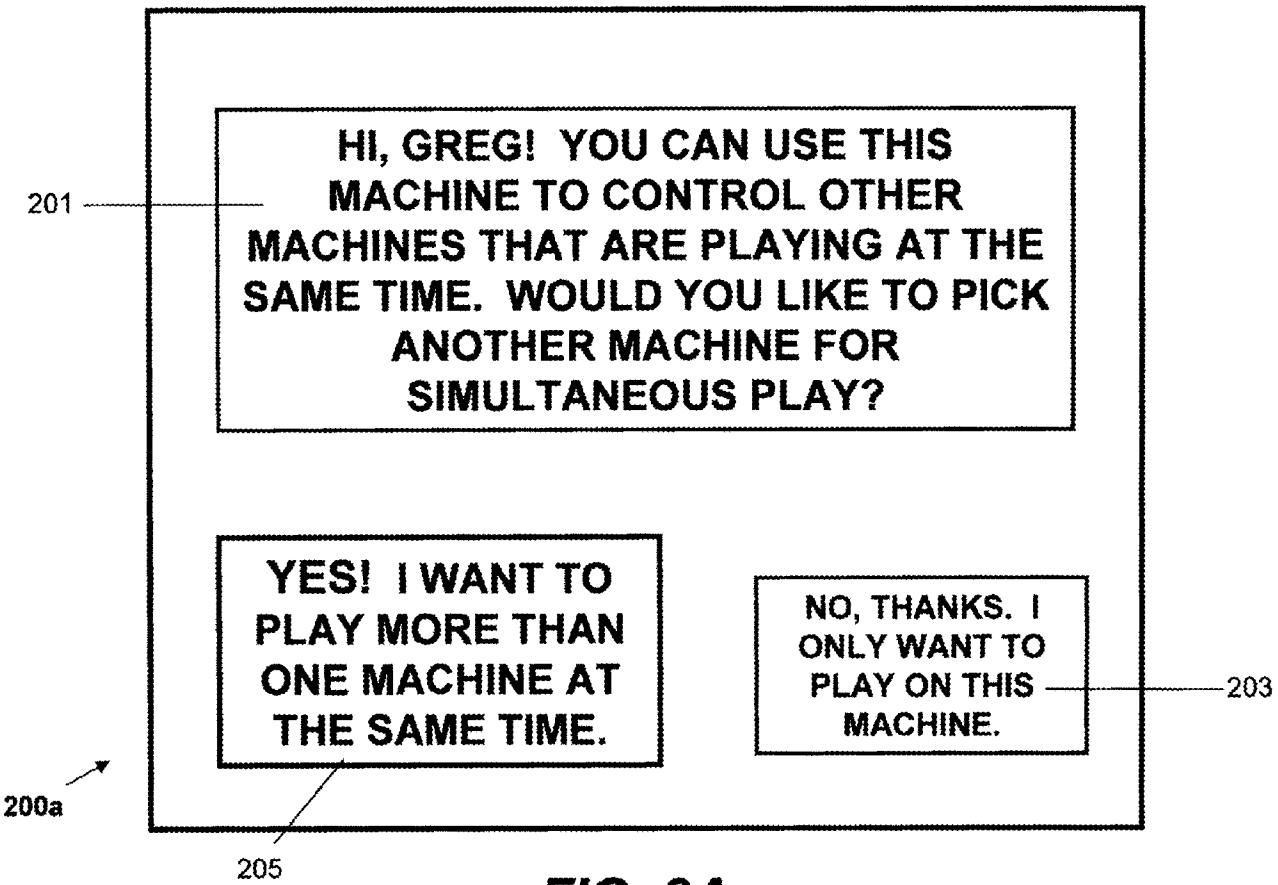
FIGS. 2A through 2D provide examples of graphical user interfaces that may be presented to allow a player to select wager gaming machines for a wager gaming session involving concurrent use of multiple wager gaming machines.

In this example, step 101 involves presenting a visual prompt to a player on a display device of a wager gaming machine. One such visual prompt is shown in FIG. 2A. Here, graphical user interface ("GUI") 200*a* is presented after a patron has provided a player loyalty device to the wager gaming machine, e.g., by inserting a player loyalty card into the wager gaming machine. In alternative implementations, a prompt may be given when a patron enters credit into the wager gaming machine, when a patron is detected near the wager gaming machine and/or made without reference to a particular patron, e.g., as part of an attraction sequence.

Here, the patron is advised by area 201 of GUI 200*a* that this wager gaming machine can operate either in "single-machine" mode or can be used to control simultaneous play on multiple wager gaming machines. Area 201 also invites the player to select one of the two options. If the player wants to play in "single-machine" mode, the player can select the option indicated by area 203, e.g., by touching that portion of the display or by using another user interface device, such as a button of a button panel. If the player chooses the single-machine option, it will be determined in step 105 (see FIG. 1) that the patron does not wish to have a wager gaming session that involves multiple wager gaming machines. Accordingly, a single-machine wager gaming session will be provided if the player provides sufficient indicia of credit, etc. (Step 107.) In some implementations, the single-machine option will be a default option. In some such implementations, if a player provides sufficient credit for game play but does not respond to a prompt to choose between single-machine play and multiple-machine play, a single-machine wager gaming session will be provided.

However, if the player selects the option indicated by area 205 of FIG. 2A, it will be determined in step 105 that the patron wants to have a wager gaming session that involves multiple wager gaming machines. In some implementations, as here, the player will then be allowed to make selections that pertain to multiple-wager-gaming machine play. In some alternative implementations, a session involving multiple wager gaming machines may be automatically enabled, e.g., by assigning a predetermined number of the closest available wager gaming machines.

Figure 2B:
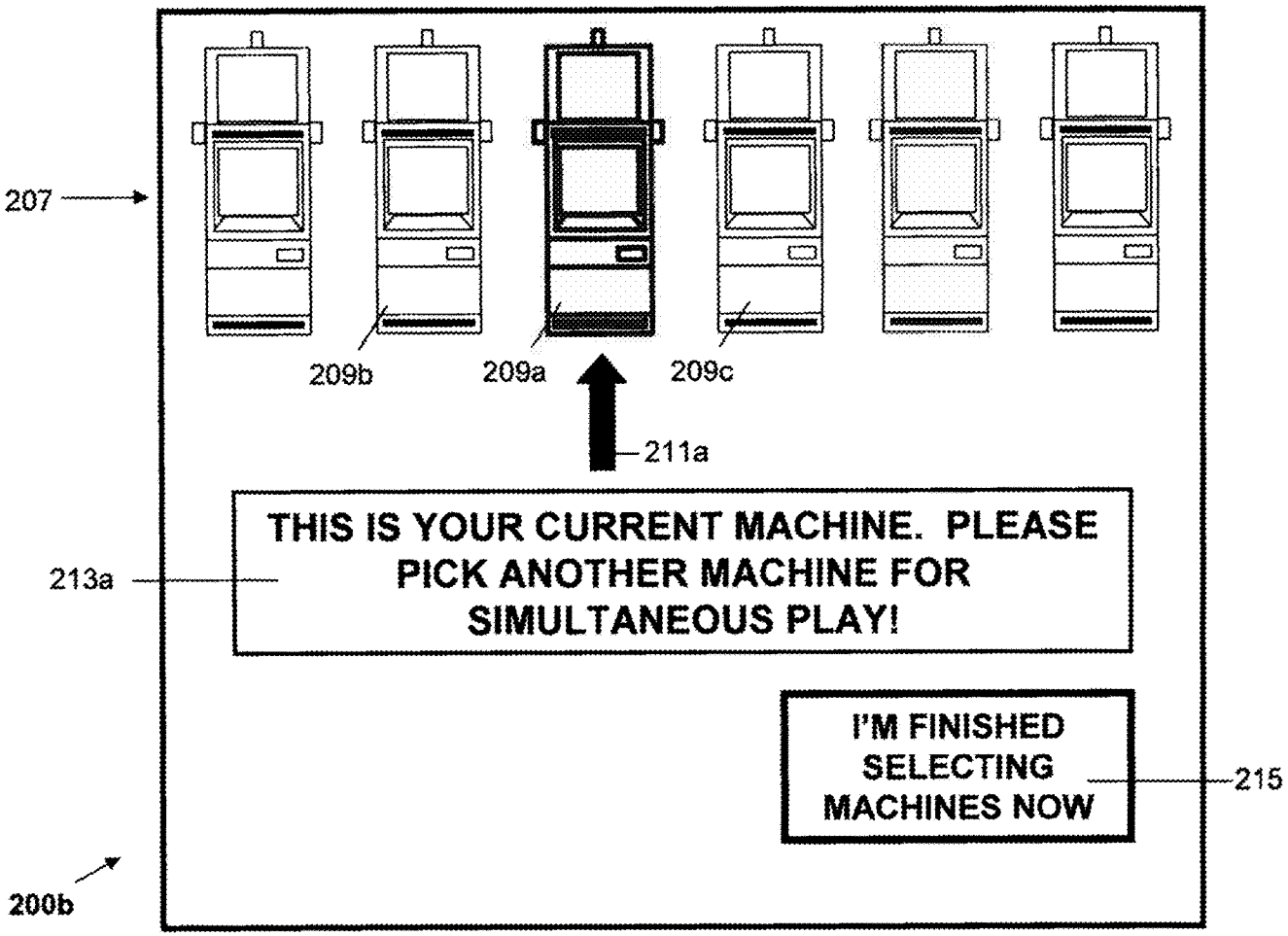

In this example, nearby wager gaming machines are polled to determine their availability for use in a concurrent gaming session (step 108) and then a player will be provided a user interface that allows the player to select one or more additional wager gaming machines, if any are available. (Step 110.) For example, in step 108 a logic device (e.g., of wager gaming machine 209*a*, of a server, of a bank switch, etc.) may query another logic device (e.g., of the selected wager gaming machine, of a bank switch, of a server or of another device of the casino's system) to determine the availability of nearby wager gaming machines for use in a concurrent gaming session. The player may, e.g., be presented with a GUI such as that depicted in FIG. 2B. GUI 200*b* includes area 207, in which a plurality of wager gaming machines 209 near the player are depicted. As indicated by pointer 211*a* and the message in area 213*a*, the patron's current wager gaming machine is machine 209*a*. Here, wager gaming machine 209*a* is one machine of a row of wager gaming machines and other wager gaming machines in the row are depicted in area 207.

Whether or not the depicted wager gaming machines are in the same row, the depicted wager gaming machines are preferably close enough to the player that wagering games presented on them are potentially viewable by the player. For example, alternative implementations may depict wager gaming machines within a predetermined radius of the player, those within the predetermined radius that have a predetermined orientation relative to the player, etc. Whether the wagering games presented on the depicted wager gaming machines are actually viewable by the player may depend on various factors, such as the number of nearby players, the arrangement of the wager gaming machines, the height of the player, etc.

In some implementations, only wager gaming machines that are currently available are indicated in area 207. In other implementations, nearby wager gaming machines may be indicated in area 207 even if they are not available. If so, unavailable wager gaming machines may be depicted in a manner that indicates that they are unavailable. For example, wager gaming machines that are available may be portrayed using bright colors whereas those which are unavailable may be shown using faded colors. Alternatively, unavailable wager gaming machines may be crossed out, may be labeled "IN USE," etc. Furthermore, the GUI may preclude wager gaming machines that are unavailable from being selectable by the player.

The message in area 213*a* also prompts the patron to select another wager gaming machine for concurrent play. (Step 115.) In this example, when a player's selection of another wager gaming machine is received (step 120), it will be determined whether the selected wager gaming machine is still available. (Step 125.) In alternative embodiments, step 125 may not be necessary. For example, after initially determining that an identified wager gaming machine is available for concurrent play, that wager gaming machine may remain available for a predetermined time to allow the player time to select one or more machines for concurrent play. For example, a credit input device and/or other features of the identified wager gaming machine may be temporarily disabled even before any selection is made by the player. If the identified wager gaming machine is not available, the patron will be so advised and will be prompted to select another wager gaming machine. (Step 115.)

In this example, the patron selects wager gaming machine 209*b*, which is adjacent to, and on the left side of, wager gaming machine 209*a*. Here, the patron selects wager gaming machine 209*b* by selecting the corresponding wager gaming machine icon in area 207, e.g., by touching that portion of area 207 or by using another user interface device to select that icon. Wager gaming machine 209*a* makes a query and receives a response indicating that wager gaming machine 209*b* is still available. In some implementations, there may be an authentication process to ensure that, e.g., an unauthorized device does not establish control over wager gaming machine 209*b*.

In some implementations, as here, after determining that a selected wager gaming machine is still available, at least part of the functionality of the selected wager gaming machine will be disabled. (Step 130.) In this example, wager gaming machine 209*a* has sent an indication to disable at least part of the functionality of wager gaming machine 209*b*. For example, wager gaming machine 209*a* may send a request to a device (e.g., a server, a bank switch, etc.) of a casino's computer system. If the request is approved, the device will send a command to disable at least part of the functionality of wager gaming machine 209*b*. Alternatively, wager gaming machine 209*a* may send a request, a command, etc., directly to wager gaming machine 209*b*. In other implementations, if it is determined that a selected wager gaming machine is available, that wager gaming machine will be instructed to partially disable itself without the need for a further request, command, etc., from wager gaming machine 209*a*.

Although not all implementations of the invention involve disabling the functionality of other wager gaming machines, it can be advantageous to disable at least some of such functionality. For example, disabling the functionality of other wager gaming machines involved in simultaneous multi-machine play can reduce the potential for contention with other players who may wish to play one of the machines selected for concurrent play. If, for example, user input devices (such as buttons on a button panel, GUIs on a display screen, etc.) and/or the device(s) for receiving indicia of credit (such as currency, tickets, etc.) on wager gaming machine 209*b* were disabled, it would be more obvious to another player that this machine is currently in use and is not available.

Similarly, if a player tracking card reader (or other mechanism for interacting with a player loyalty device, such as a radio frequency identification ("RFID") reader) of wager gaming machine 209*b* were disabled, it should be evident to another player that wager gaming machine 209*b* is not available. For example, a bezel may normally light up after a player inserts a player loyalty card. If the bezel does not light up after the player inserts the player loyalty card, the player receives an indication that this feature has been temporarily disabled. In some implementations, at least some of the other functionality of a wager gaming machine's logic system, input/output system, peripheral devices, etc., may be disabled. For example, some of the functionality of a credit input device, a player tracking (or other) card reader, etc., may be disabled. A master gaming controller of wager gaming machine 209*b* may be configured to receive user input, credit data, etc. from wager gaming machine 209*a*, e.g., via a network interface, an infrared, radio frequency or other interface, etc.

Figure 2C:
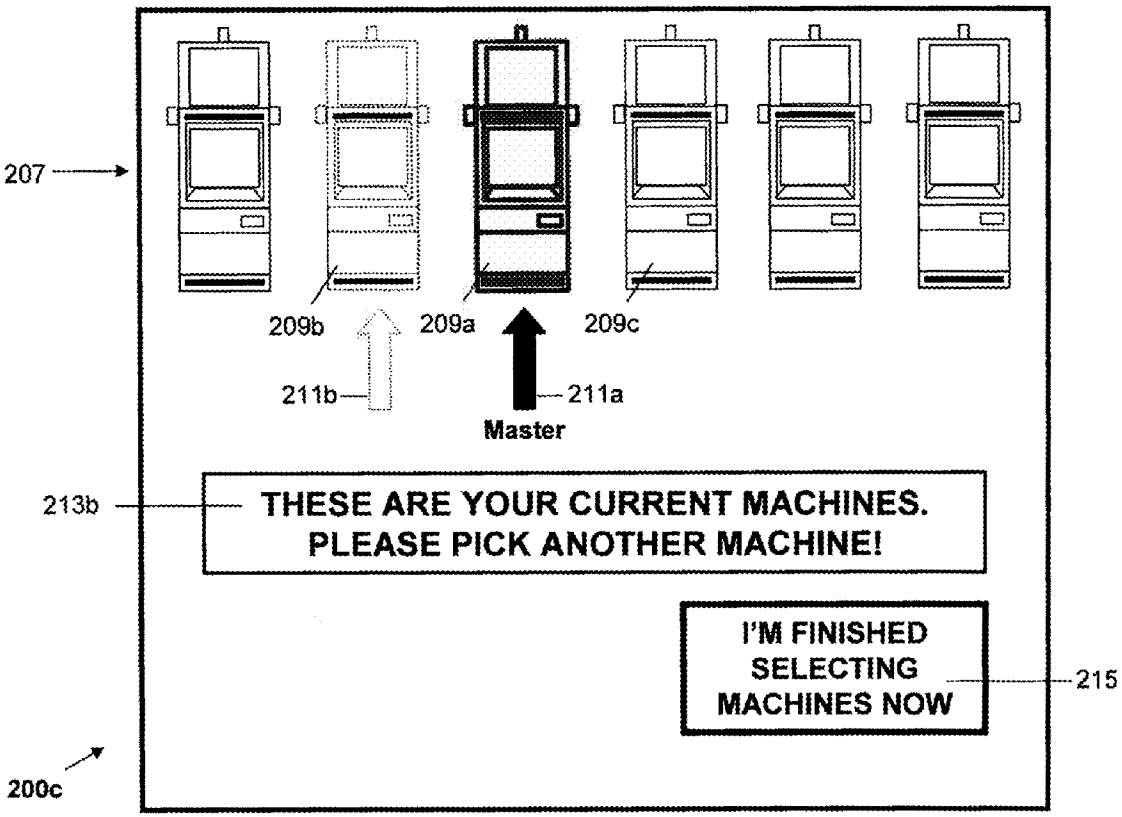

FIG. 2C indicates GUI 200*c* at a time after the patron has selected wager gaming machine 209*b* and it has been determined that wager gaming machine 209*b* is available. Wager gaming machine 209*b* may or may not have been partially disabled at this time, according to the implementation. Here, pointers 211*a* and 211*b*, and the associated text in area 213*b*, indicate that wager gaming machines 209*a* and 209*b* are now assigned to the same player. Pointer 211*a* and the associated text indicate that wager gaming machine 209*a* is the master gaming machine. Data structures in one or more memories (e.g., of wager gaming machine 209*a*, wager gaming machine 209*b*, a bank switch, a server, etc.) may be updated to indicate the current relationship between wager gaming machine 209*a* and wager gaming machine 209*b*. For example, the data structure(s) may be configured to indicate that wager gaming machine 209*b* will receive user input data, credit data, etc., from wager gaming machine 209*a*, that wager gaming activities on both machines will be attributed to the player of wager gaming machine 209*a*, etc. The text in area 213*b* encourages the player to select another wager gaming machine.

In this example, the player decides to select another wager gaming machine. Here, the patron selects wager gaming machine 209*c* by selecting the corresponding wager gaming machine icon in area 207, e.g., by touching that portion of area 207 or by using another user interface device to select that icon. After receiving the player's indication identifying another wager gaming machine (step 120), wager gaming machine 209*a* makes a query and receives a response indicating that wager gaming machine 209*c* is available. (Step 125.) Accordingly, part of the functionality of wager gaming machine 209*c* is disabled. (Step 130.)

Figure 2D:
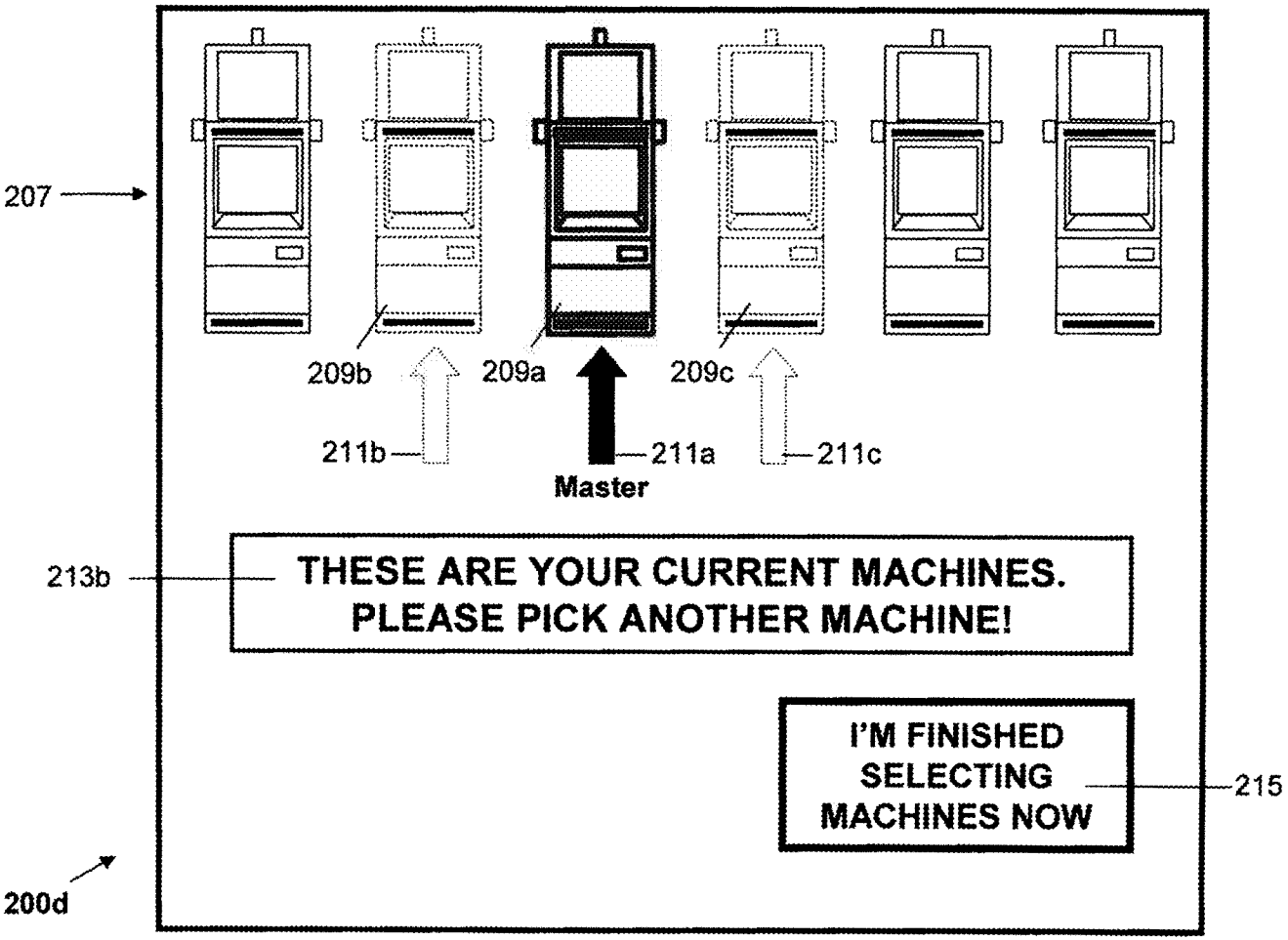

FIG. 2D indicates GUI 200*d* at a time after the patron has selected wager gaming machine 209*c* and it has been determined that wager gaming machine 209*c* is available. Wager gaming machine 209*c* may or may not have yet been partially disabled at the indicated time, depending on the implementation. Here, pointers 211*a*, 211*b* and 211*c*, along with the associated text in area 213*b*, now indicate that wager gaming machines 209*a*, 209*b* and 209*c* are now assigned to the player. Pointer 211*a* and the associated text indicate that wager gaming machine 209*a* is the master gaming machine. Data structures in one or more memories (e.g., of wager gaming machine 209*a*, wager gaming machine 209*b*, a bank switch, a server, etc.) may be updated to indicate the current relationship between wager gaming machine 209*a* and wager gaming machine 209*c*. For example, the data structure(s) may be configured to indicate that wager gaming machine 209*c* will receive user input data, credit data, etc., from wager gaming machine 209*a*, that wager gaming activities on both machines will be attributed to the player of wager gaming machine 209*a*, etc. The text in area 213*b* encourages the player to select another wager gaming machine.

However, the player decides not to select any additional wager gaming machines at this time. Accordingly, the player interacts with area 215, e.g., by pressing the corresponding part of a touch screen. Therefore, it is determined in step 135 that the player is finished identifying wager gaming machines for the present time.

Although FIG. 1 could be interpreted to mean that all additional wager gaming machines are identified prior to step 140, this is not necessarily the case. In some implementations, a player may have the option of flexibly and conveniently adding wager gaming machines to, and/or removing wager gaming machines from, the wager gaming machines currently assigned to the player for concurrent play. For example, one or more of the GUIs presented to a player during step 140, step 145 and/or step 150 may allow a player to add a wager gaming machine to and/or remove a wager gaming machine from, the wager gaming machines currently assigned to the player.

After the player is finished identifying wager gaming machines (at least for the moment), the player will be preferably be provided with some type of user interface for controlling game play on more than one wager gaming machine. This feature is not necessary for implementing all aspects of the invention, but can significantly increase player convenience and satisfaction when implemented. In some implementations, as here, the player will be able to provide credit, initiate play and/or make game-related responses for all associated wager gaming machines from a single one of the wager gaming machines. The single wager gaming machine may sometimes be referred to herein as a "master" wager gaming machine or the like. In some such implementations, one or more user input devices (such as buttons, switches, etc. on a "master" wager gaming machine may be used to provide user input regarding play on all associated machines. In this example, a GUI is provided for controlling multiple wager gaming machines from a master wager gaming machine. (Step 140).

Figure 3A:
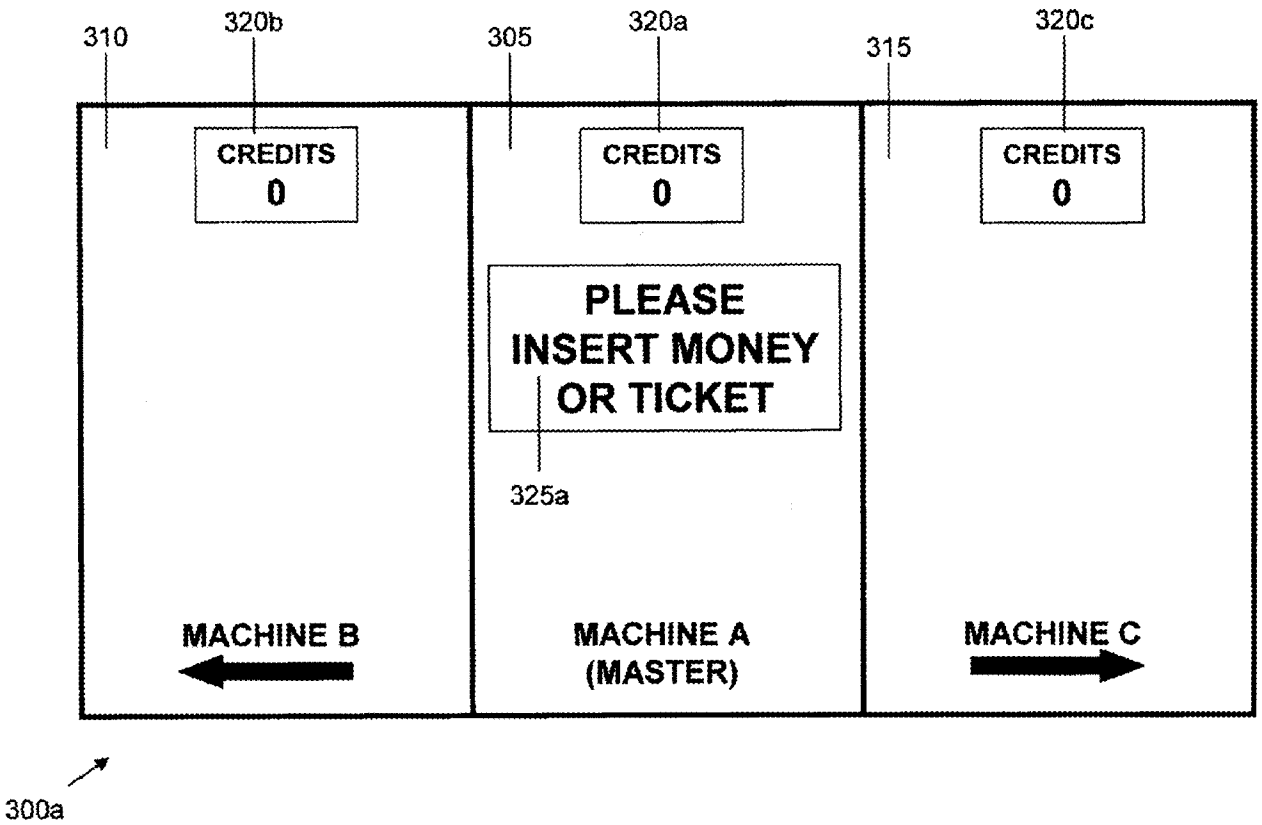
FIGS. 3A through 3G provide examples of graphical user interfaces that may be presented to a player for establishing and controlling a wager gaming session involving concurrent use of multiple wager gaming machines.

Examples of GUIs that may be used for controlling multiple wager gaming machines from a master wager gaming machine are provided in FIG. 3A et seq. In this example, GUI 300*a* of FIG. 3A is presented on wager gaming machine 209*a*, which is the master wager gaming machine. GUI 300*a* includes areas 305, 310 and 315, which correspond to wager gaming machines 209*a*, 209*b* and 209*c*, accordingly. Here, wager gaming machines 209*a*, 209*b* and 209*c* are presented to the player as wager gaming machines A, B and C.

Credit meters 320*a*, 320*b* and 320*c* indicate how much credit is available for wager gaming on wager gaming machines A, B and C, accordingly. In this example, the player has not yet provided credit for game play: credit meters 320*a*, 320*b* and 320*c* all indicate zero credits. Accordingly, area 325 prompts the player to provide one or more indicia of credit (such as currency, a ticket, a voucher, etc.) to wager gaming machine 209*a*. Wager gaming machine 209*a* may provide other prompts, e.g., an audio prompt, a light associated with a bill and/or ticket validator may flash, etc.

Figure 3B:
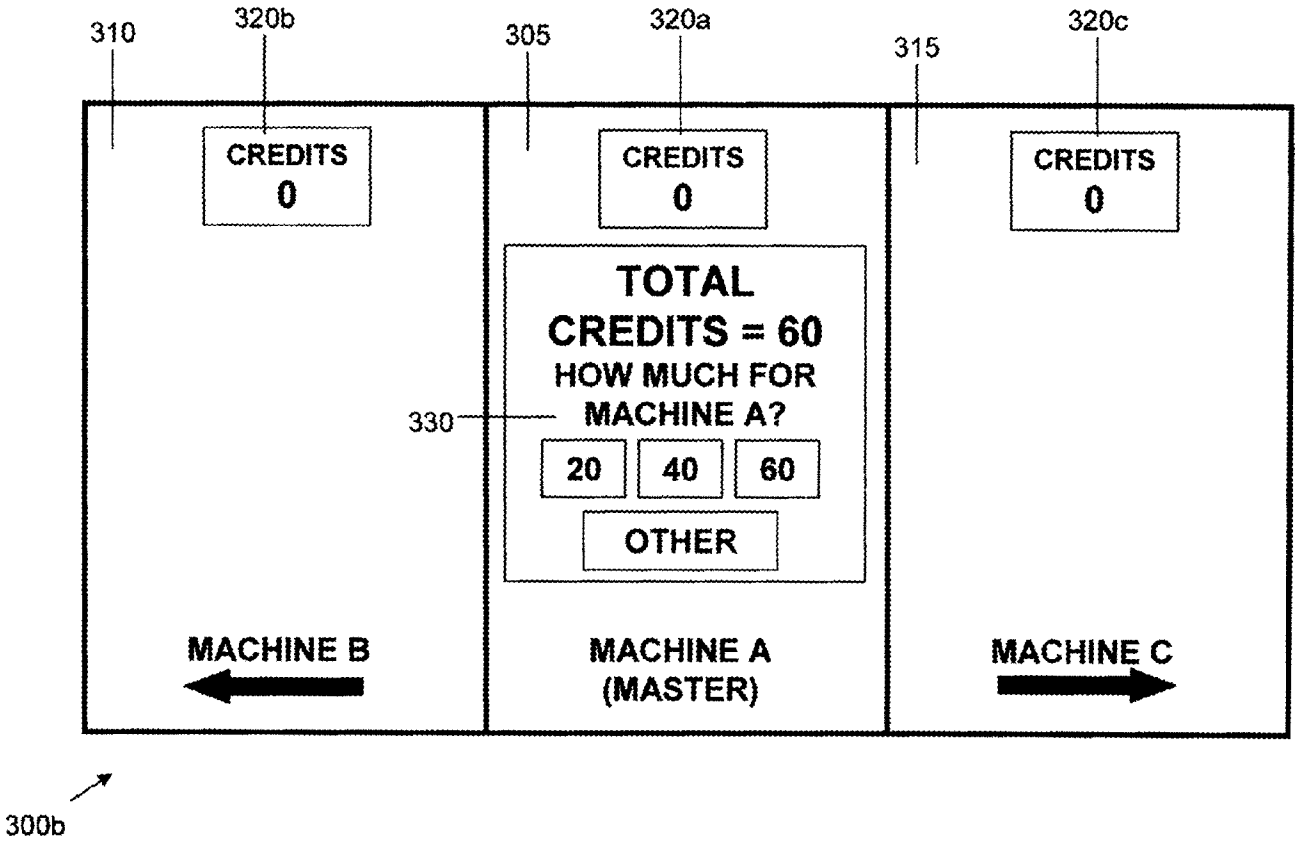

At the time that GUI 300*b* of FIG. 3B is presented, the player has provided one or more indicia of credit to wager gaming machine 209*a*, totaling 60 credits. In some implementations, the credits provided by a player may be automatically apportioned to the participating wager gaming machines. However, in this example, GUI 300*b* provides a player the option of apportioning the credits to each wager gaming machine as he or she chooses.

Accordingly, area 330 informs the player of the total credits accepted by wager gaming machine 209*a* and prompts the player to indicate how much of that total will be apportioned to wagering on machine A, the master wager gaming machine. A player may indicate how many credits to apportion by interacting with GUI 300*b*, e.g., by touching or otherwise selecting the corresponding portion of area 330.

Figure 3C:
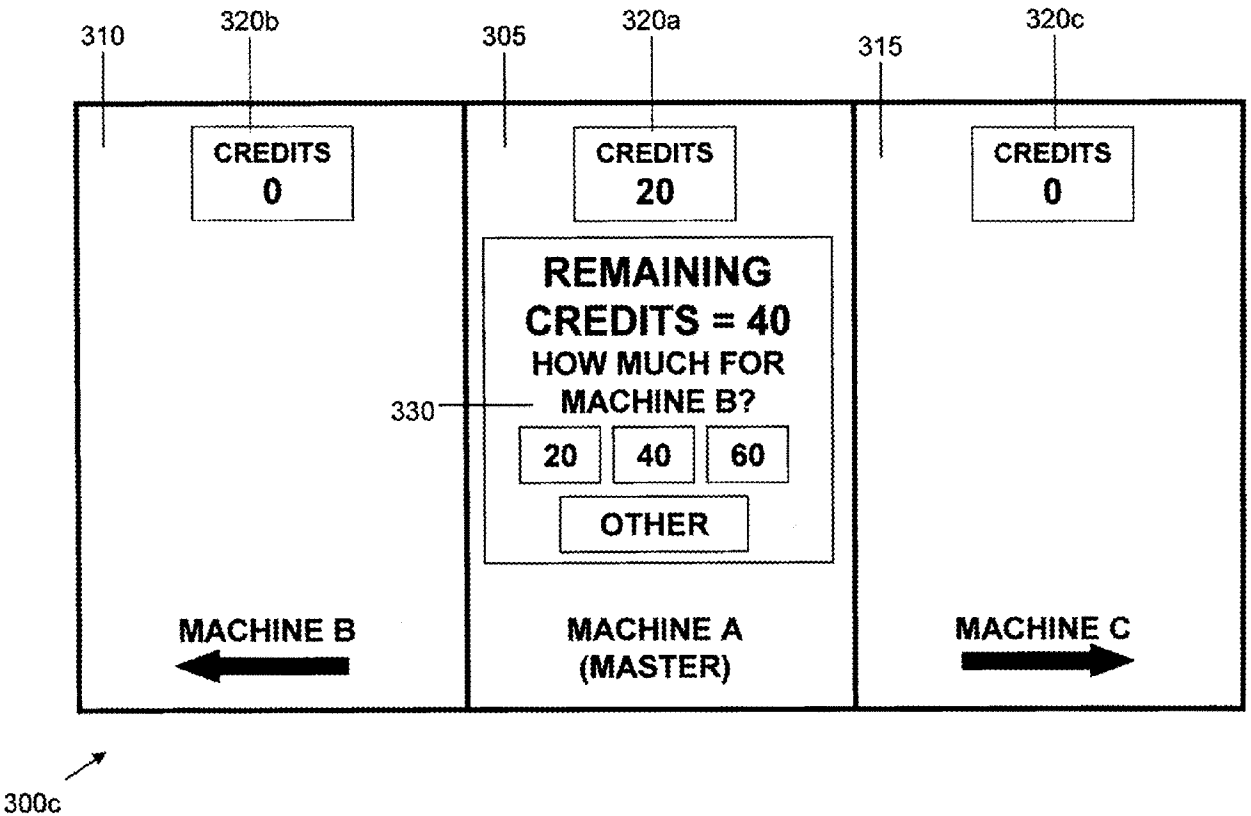

As indicated in GUI 300*c* of FIG. 3C, the player has decided to apportion 20 credits for wagering on machine A: credit meter 320*a* indicates 20 credits. Area 330 now indicates the number of remaining credits (40) and prompts the player to indicate how many of the remaining credits to apportion to machine B.

Figure 3D:
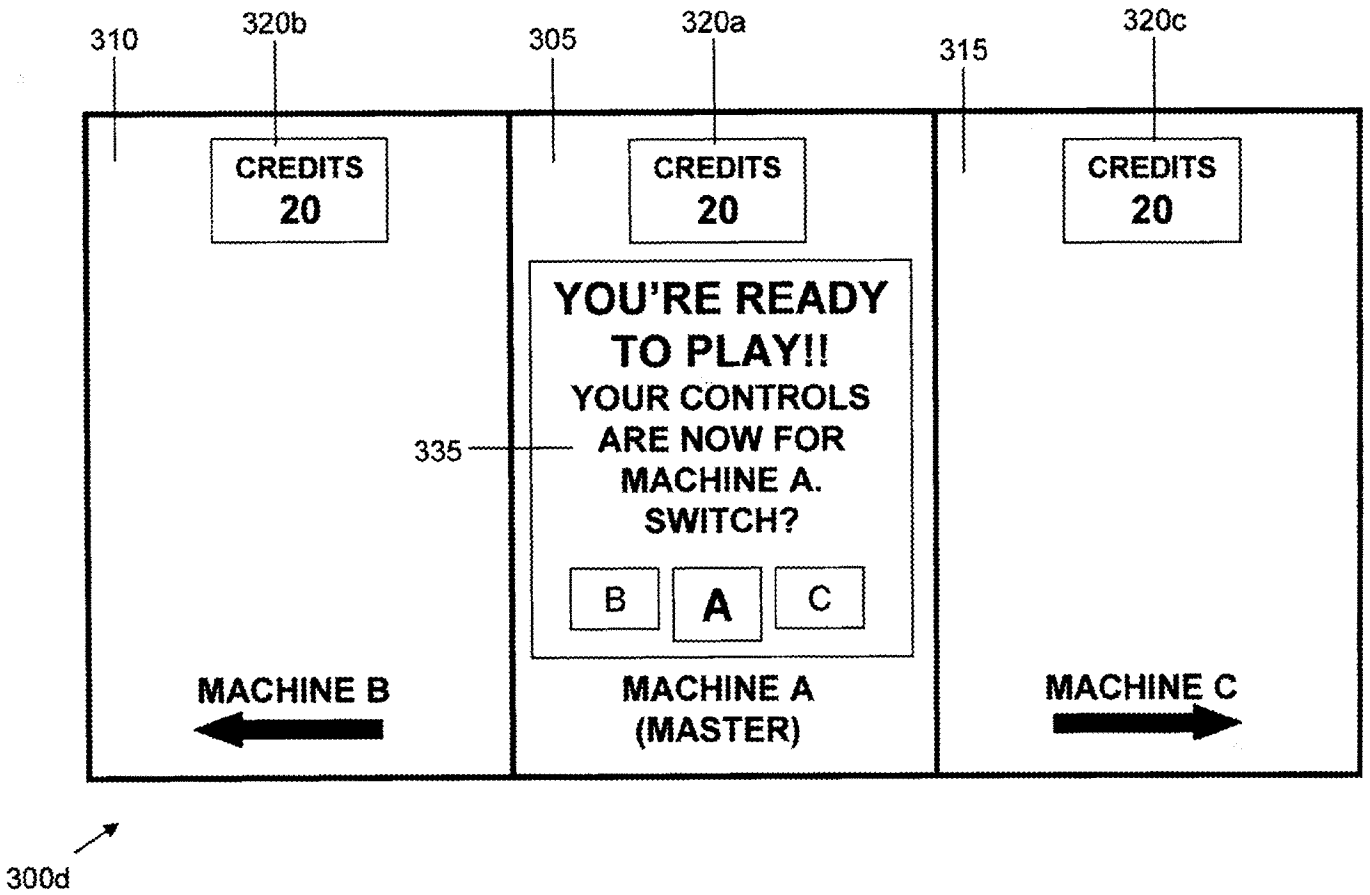

As shown in GUI 300*d* of FIG. 3D, the player has chosen to apportion 20 credits to machine B. (See credit meter 320*b*.) A logic device of machine A (or another device) may send credit data to another logic device (e.g., of machine B) indicating that 20 credits are available for wager gaming on machine B. In this example, wager gaming machine 209*a* automatically apportions the remaining credits to machine C without the need for further input from the player. (See credit meter 320*c*.) A logic device of machine A (or another device) may send credit data to another logic device (e.g., of machine C) indicating that 20 credits are available for wager gaming on machine C.

The present invention provides various embodiments by which a selected wager gaming machine may be configured, at least temporarily, as a master by providing user input regarding all wager gaming machines that will be involved in this wager gaming session. In some such embodiments, one or more GUIs on the master wager gaming machine will allow a player to provide input corresponding to each machine. For example, in a layout generally like that of GUI 300*d*, areas 305, 310 and 315 may each provide separate areas for providing user input for wager gaming machines A, B and C, respectively.

In other embodiments, dedicated and/or configurable buttons or other user input devices on the master wager gaming machine may be used to provide user input for each machine. For example, wager gaming machine 209*a* may have one or more configurable buttons for which a different appearance and/or functionality may be provided, e.g., according to data downloaded from a central system. The buttons may be configured, for example, according to the number of wager gaming machines involved, the type of wagering game presented and/or other factors. In other embodiments, a button panel and/or other user input devices may be pre-configured to support play on multiple wager gaming machines. A portion of the input devices may indicate "machine 1" (or the like), another may indicate "machine 2" (or the like) and so on.

In the example depicted in FIG. 3D, however, a player may use the user input devices on wager gaming machine 209*a*, the master wager gaming machine, to provide input regarding all wager gaming machines that will be involved in this wager gaming session. By selecting the appropriate part of area 335, a player may indicate for which wager gaming machine the player will be providing input using the same user input devices of wager gaming machine 209*a*. The user input devices may be those, or may at least be similar to those, of a standard wager gaming machine. In this example, the letter of the currently-selected wager gaming machine will increase in size and be presented in bold. Moreover, the text of area 335 will advise the player of the wager gaming machine for which input can now be provided by using the user input devices on wager gaming machine 209*a*.

Figure 3E:
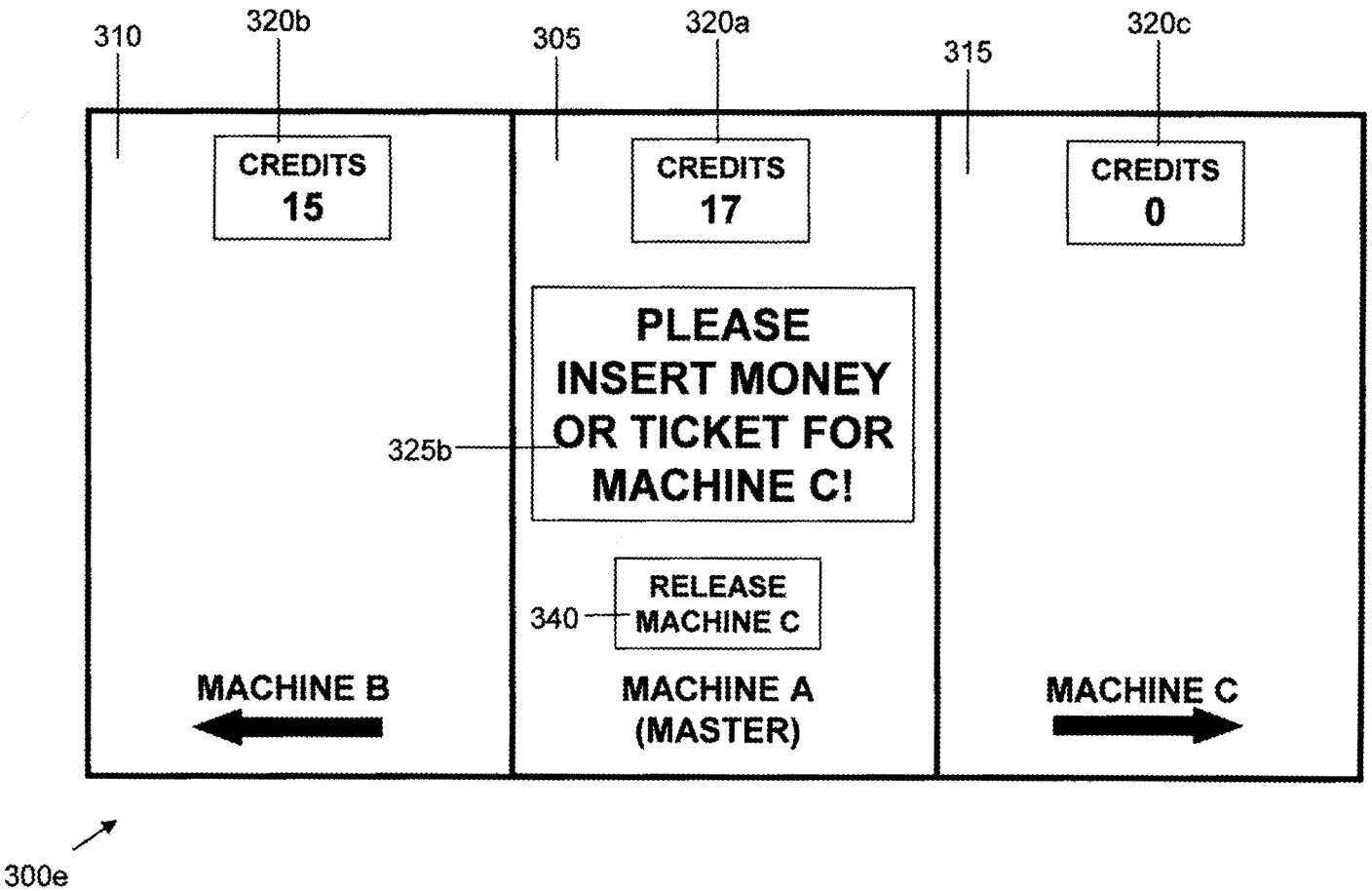

During game play, money will typically be won and/or lost at different rates by the wager gaming activities on machines A, B and C. At the time that GUI 300*e* of FIG. 3E is presented, no more credits are available for wager gaming on machine C: credit meter 320*c* indicates zero credits. Therefore, area 325*b* prompts the player to provide additional credit for machine C. In this example, area 340 provides the player an alternative option of releasing machine C and continuing concurrent wager gaming with machines A and B.

Figure 3F:
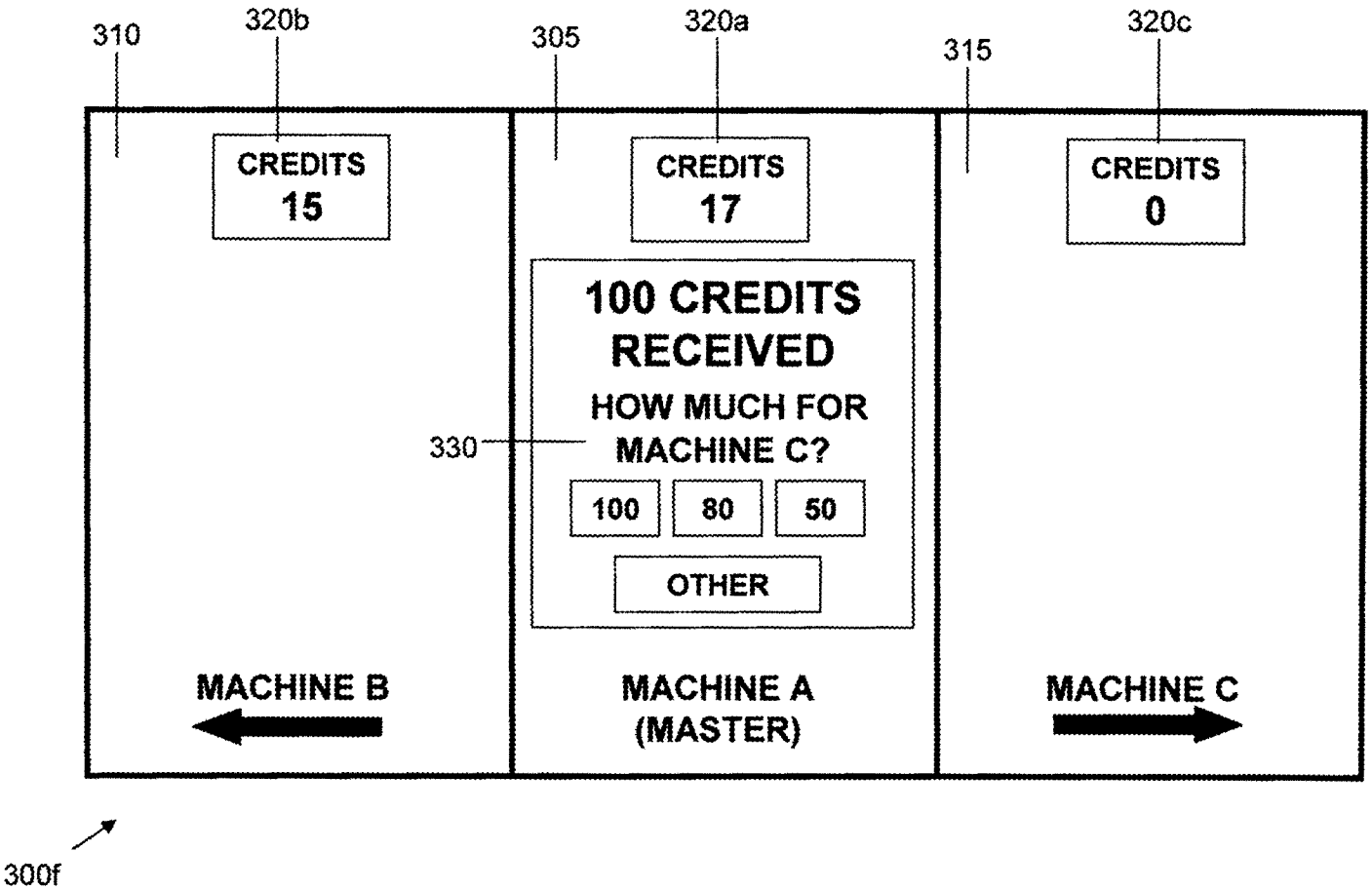

However, in this example, the player decides to provide more credit for machine C. As shown in area 330 of GUI 300*f* (see FIG. 3F), the player has provided 100 additional credits. The player may indicate how much credit to provide wager gaming machine C by selecting the corresponding part of area 330. Remaining credits, if any, may be apportioned to the other participating wager gaming machines.

It will be appreciated from the foregoing discussion that some implementations of the invention provide at least some level of coordination between participating wager gaming machines. Accordingly, in step 145 of FIG. 1, the responses of participating wager gaming machines will be coordinated. The level and type of coordination may vary according to the implementation.

Figure 3G:
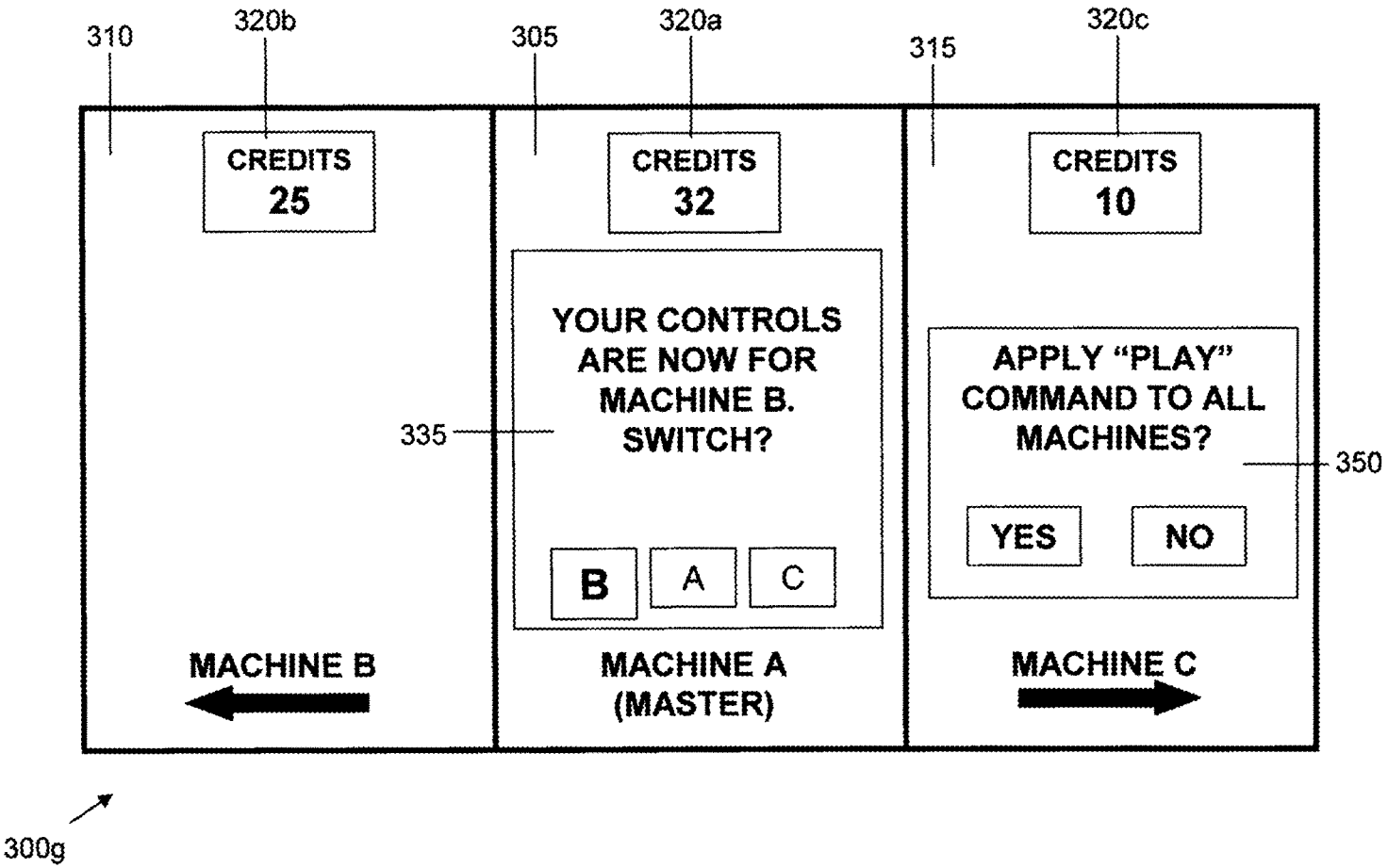

Some implementations may, for example, allow a player to send a "play" command (or the like) to all participating wager gaming machines at approximately the same time. One such implementation is depicted in FIG. 3G. At the time that GUI 300*g* is presented, user input devices of the master wager gaming machine are currently providing input relating to machine B. However, area 350 of GUI 300*g* allows the player have a single "play" command (or the like) to be applied simultaneously to all participating wager gaming machines.

Figure 4:
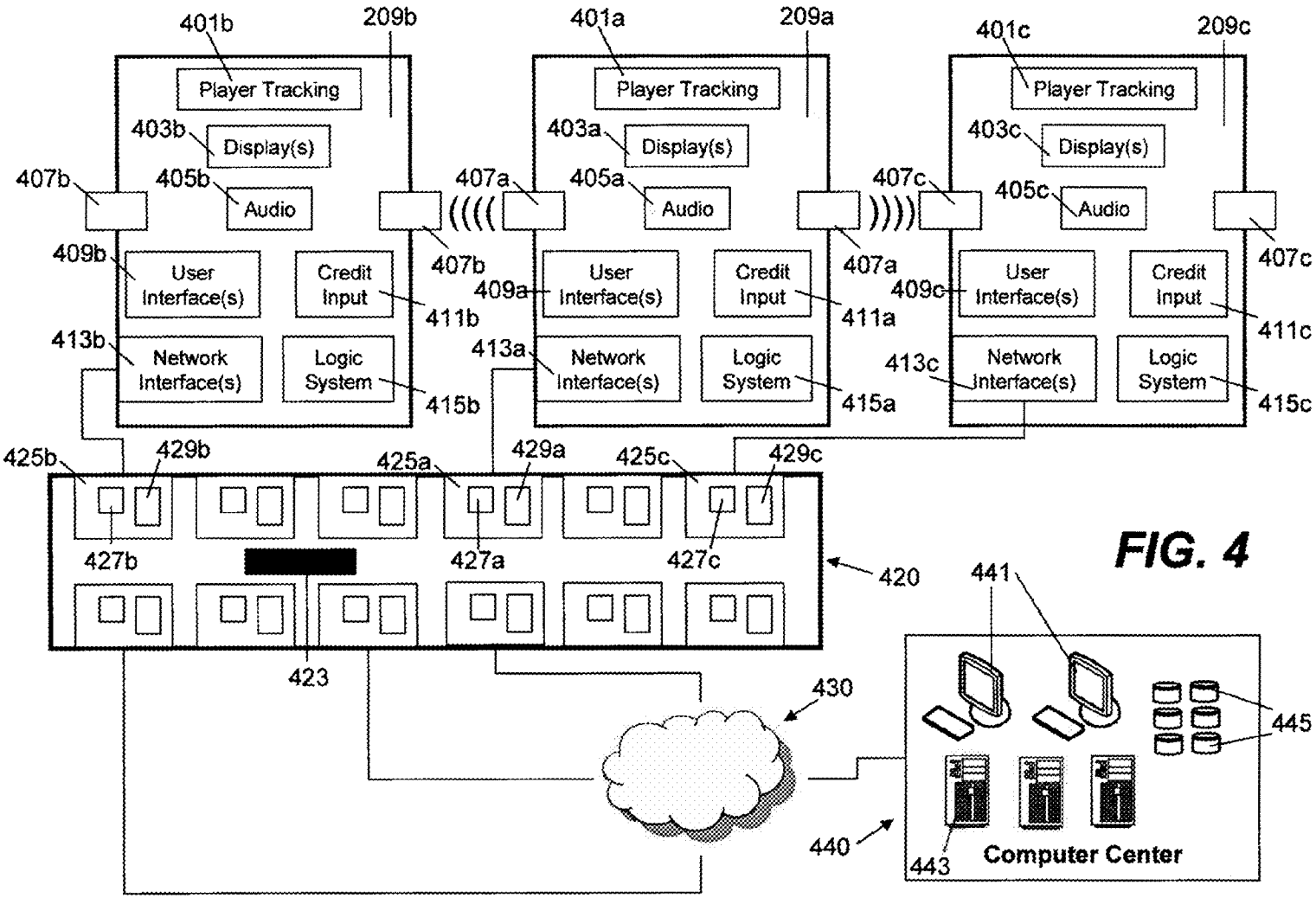
FIG. 4 is a block diagram of wager gaming machines and other devices that may be used for providing a wager gaming session involving concurrent use of multiple wager gaming machines.

In some implementations, data regarding the wager gaming on all participating wager gaming machines will be reflected in the player's player loyalty account. Referring now to FIG. 4, when a player is involved in a wager gaming session involving wager gaming machines 209*a*, 209*b* and 209*c*, data regarding the wager gaming on all three wager gaming machines may be reflected in the player's player loyalty account. The player may, for example, only need to provide a player loyalty device (e.g., to insert a player tracking card or the like) to player tracking system 401*a* of wager gaming machine 209*a*, but player loyalty points for the wager gaming on wager gaming machines 209*b* and 209*c* will also be credited to the player's player loyalty account.

In some such implementations, the card readers (or the like) of player tracking systems 401*a* and 401*b* of wager gaming machines 209*b* and 209*c* may have been temporarily disabled according to the indication sent in step 130 of FIG. 1. User interfaces 409*b* and 409*c* and/or credit input devices 411*b* and 411*c* of wager gaming machines 209*b* and 209*c* may also have been temporarily disabled. Logic systems 415*b* and 415*c* may have been reconfigured to accept credit input data and/or user input data from wager gaming machine 209*a*. Relevant data may be stored in a local memory (e.g., of logic systems 415*b* and 415*c*) and/or other memory (e.g., of bank switch 420, one or more of servers 443, storage devices 445, etc.

Credit input data, user input data and/or other such data may, for example, be sent from logic system 415*a* via network interface system 413*a* and received via network interface systems 413*b* and 413*c*. In some such implementations, one or more logic devices of a network device may provide related functionality. For example, processor 427*a* of line card 425*a* may be configured to forward credit input data and/or user input data from wager gaming machine 209*a* to logic system 415*b*, via line card 425*b* or to logic system 415*c*, via line card 425*c*. Forwarding data may be established after wager gaming machines are selected by a patron (e.g., during a process such as that described above) and stored in a memory of bank switch 420, e.g., memory 429*a* of line card 425*a*.

As mentioned elsewhere herein, in some implementations game services, including but not limited to the determination of game outcomes, the aggregation of wager gaming machines for a concurrent gaming session, the provision of player loyalty services, accounting services, etc., may be provided by one or more devices of a central system, such as host devices 441 and/or servers 443. Relevant data may be stored in one of storage devices 445, and/or in a network storage system. For the sake of simplicity, intermediate network devices (such as switches, routers, etc.) of a casino network are depicted as a cloud in FIG. 4. Central processing unit ("CPU") 423 of bank switch 420 may also be involved in communications between wager gaming machines and/or communications with computer center 440.

Alternatively, or additionally, data may be sent from logic system 415*a* via free space optical communication links 407*a* and received via free space optical communication links 407*b* and 407*c*. The free space optical communication links may, for example, comprise transmitters and receivers for infrared light according to an Infrared Data Association ("IrDA") standard, radio frequency transceivers, or any other convenient devices suitable for short-range wireless communication.

Some implementations of the invention provide at least some level of coordination of the presentations of wagering games, including but not limited to coordinating the presentations of game outcomes, between participating wager gaming machines. For example, some implementations involve a degree of coordination between sounds provided by audio systems 405*a*, 405*b* and 405*c* and/or images presented by display systems 403*a*, 403*b* and 403*c*. In some such implementations, game outcomes may be displayed in a sequential fashion, e.g., from right to left, left to right, etc., in a sequential fashion. In some implementations, game outcomes may be displayed in a substantially simultaneous fashion. Different implementations may provide varying levels of coordination between the displays.

Some gaming machines may include an interface system having at least one network interface that is configured for communication with other devices via an Ethernet standard, via Transmission Control Protocol ("TCP") and/or Internet Protocol ("IP"), etc. In some embodiments, the communication protocol used between participating wager gaming machines may be supplemented or replaced by protocols which ensure that communications are transmitted and received within a specified period of time. For example, an automotive control protocol such as CANbus™ (ISO 11898) or FlexRay™, or an industrial automation protocol such as Profibus™ (IEC 61158/IEC61784) may ensure messages are conveyed with minimal latency. In some embodiments, synchronization of networked devices may be improved by employing utilities such as the Network Time Protocol or Precision Time Protocol (IEEE 1588). Such implementations may allow game outcomes, etc., to be presented in a highly controlled manner. For example, if game outcomes are presented in a sequential fashion, e.g., from right to left, left to right, etc., the time interval between an event presented on a first wager gaming machine and a corresponding event presented on a second wager gaming machine (e.g., on an adjacent wager gaming machine) can be closely controlled.

In some implementations, coordinating the wager gaming sessions of multiple wager gaming machines will involve combining a game outcome of two or more gaming machines to produce a combined wager gaming outcome. In some such embodiments, at least one of the combined wager gaming outcomes could not be produced in its entirety by an individual gaming machine. Some examples are provided in FIGS. 5 through 7.

Figure 5:
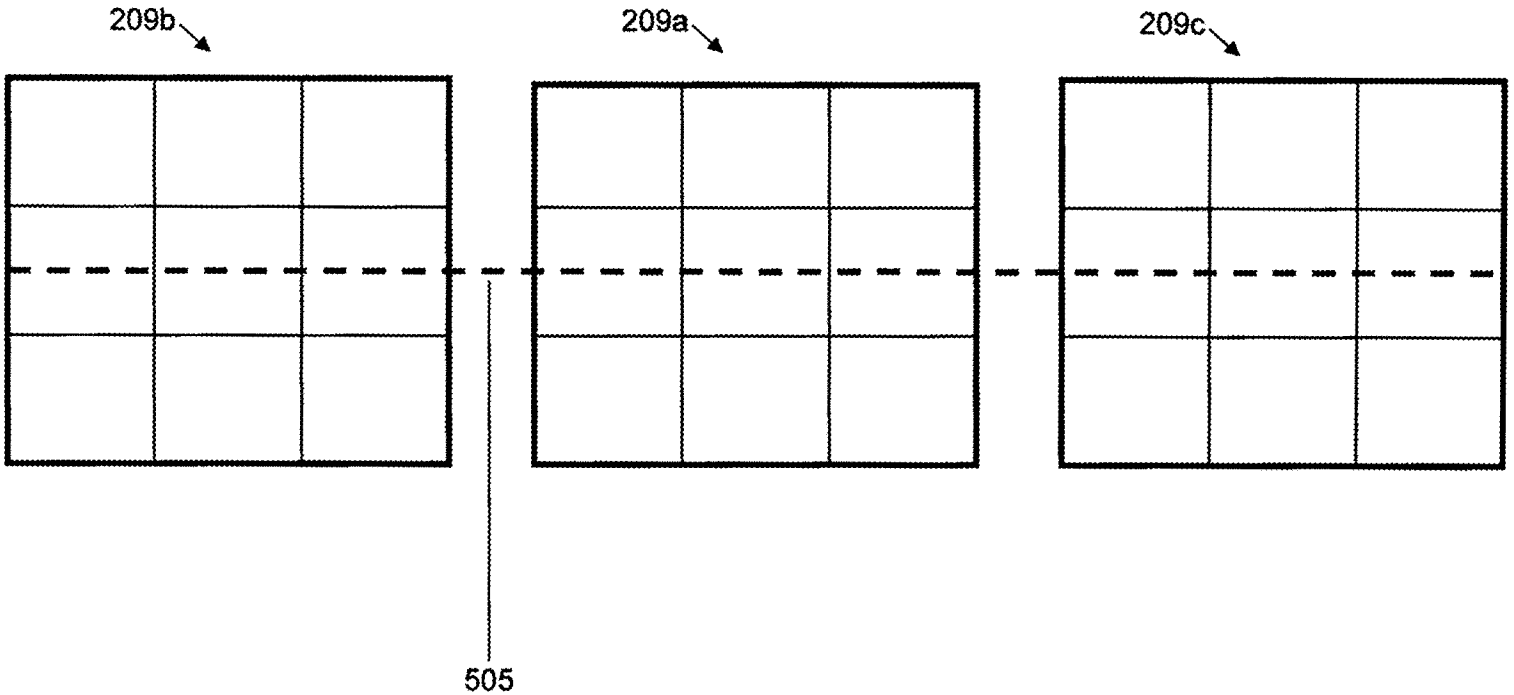
FIGS. 5 through 7 provide examples of some paylines that involve multiple slot machines involved in a concurrent wager gaming session.

Referring first to FIG. 5, a 3×3 grid is depicted for each of wager gaming machines 209*a*, 209*b* and 209*c*. These grids represent displays for a 3-reel slot game (or video simulations thereof) that are presented on wager gaming machines 209*a*, 209*b* and 209*c*. Horizontal payline 505 is depicted as spanning the slot game outcome displays of all three wager gaming machines. As suggested by this depiction, all nine symbols on payline 505 may be evaluated in a predetermined manner to determine whether a player has obtained a winning game outcome. Therefore, payline 505 may be referred to herein as a "multi-machine payline" or the like.

Because the probability of obtaining 9 of the same symbols along payline 505 is so small, the corresponding win amount may be larger than any win amount available when playing only one machine at a time. Even if a player obtained, e.g., 7 or 8 of the same symbols along payline 505, the corresponding win amount may still be larger than any win amount available when playing only one machine at a time. Because some symbols are generally more common than others, the probability of obtaining any particular symbol combination will depend on how the reels (or their representations) are formed.

The evaluation of game outcomes involving multi-machine paylines and the like may be made by reference to corresponding multi-machine paytables. Depending on the implementation, such paytables may be stored in a particular wager gaming machine (e.g., in a memory of master wager gaming machine 209*a* of FIG. 4) and referenced by a logic device of a wager gaming machine (e.g., by logic system 415*a*), stored in a memory accessible by a device of a central system that is configured to reference a multi-machine paytable and/or other paytables (e.g., one of servers 443), etc.

Figure 6:
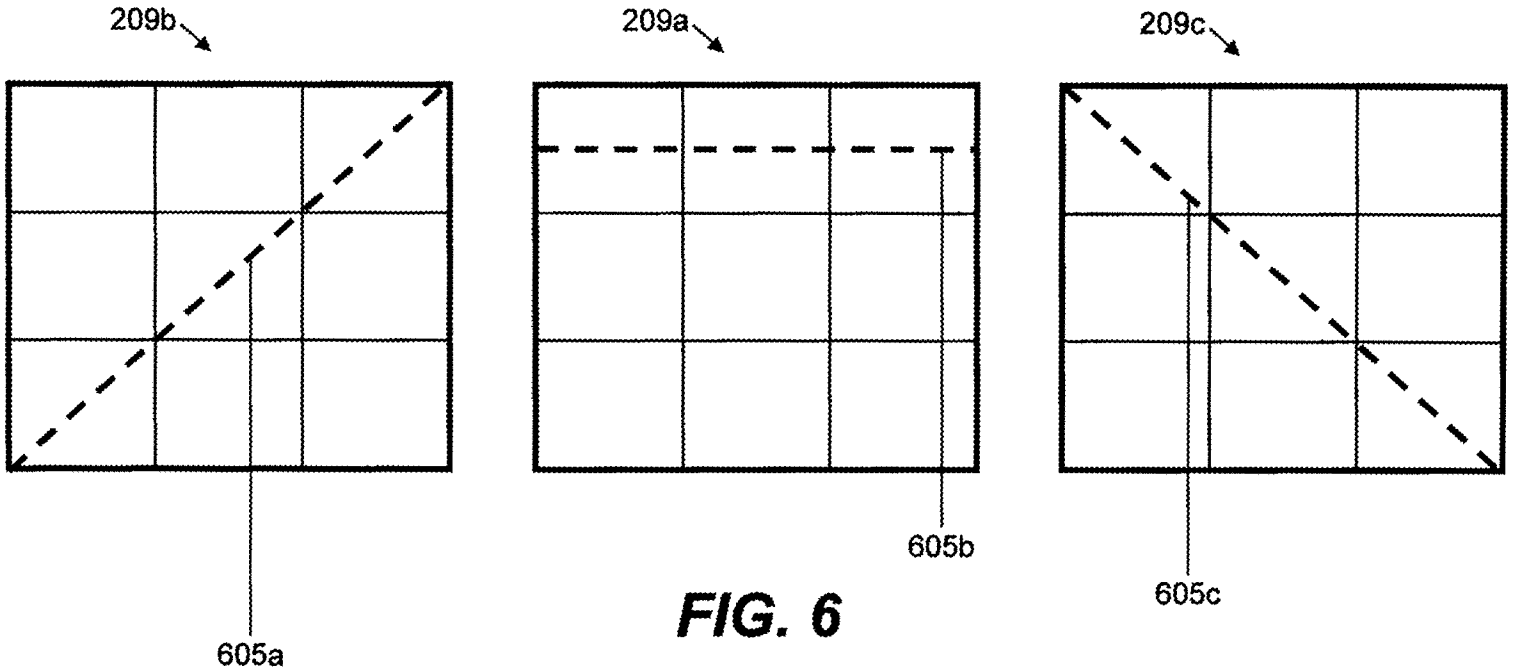
Figure 7:
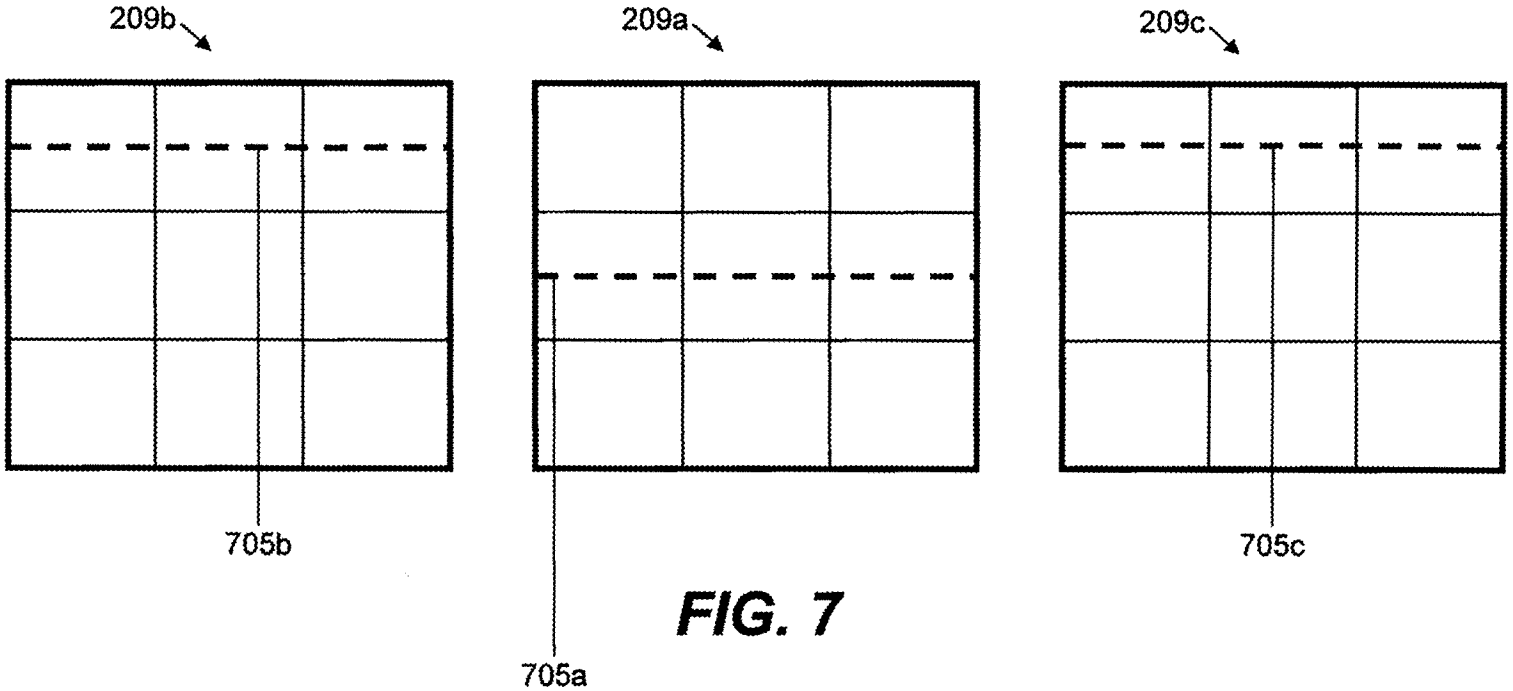

The multi-machine paylines provided herein are not limited to horizontal paylines, however. Other possible multi-machine paylines are depicted in FIGS. 6 and 7. In FIG. 6, a multi-machine payline includes diagonal portions 605*a* and 605*c*, connected by horizontal portion 605*b*. In FIG. 7, a multi-machine payline includes offset horizontal portions 705*a*, 705*b* and 705*c*. Other multi-machine paylines are within the scope of the present invention. For example, some multi-machine paylines may include only some, but not all, of the wager gaming machines being concurrently used in a gaming session. In one such example, a multi-machine payline may include only 2 out of 3 wager gaming machines currently being played.

In some embodiments, casinos may establish criteria that players must meet in order to establish and/or maintain concurrent play on multiple wager gaming machines. For example, a concurrent play option may be offered only to preferred players. Such preferred players may be, for example, players of at least a predetermined level in a player loyalty program.

In some such embodiments, the criteria for maintaining concurrent play on multiple wager gaming machines may include wager information. For example, if the time interval between a player's wagers and/or other wagering criteria (e.g., a wager amount per unit of time) drops below a predetermined level, concurrent play may be disabled, at least in part. The wagering criteria may take into account how many wager gaming machines are involved in concurrent play. For example, a wagering criterion may comprise a wagering rate (wager amount per unit time) divided by the number of wager gaming machines are involved in concurrent play.

In some such embodiments, if the criterion or criteria for concurrent play are not met, concurrent play may be partially disabled by disabling control by the wager gaming machine assigned as the master gaming controller and the wager gaming machine associated with a low wagering play may be disconnected. Alternatively, or additionally, concurrent play may be completely disabled if predetermined criteria, including but not limited to wagering criteria, are not met. Preferably, the player receives a prompt indicating that such an action will take place unless the player takes remedial action, e.g., by placing a wager of a certain amount. Such embodiments are designed to prevent players from reserving wager gaming machines only to let them stand at idle or allow them to be under-utilized.

Limits may also be placed on the number of wager gaming machines that can be involved in concurrent play. For example, a casino may determine that no more than 3 wager gaming machines can be involved in concurrent play. In some implementations, the number of wager gaming machines that can be involved in concurrent play may depend on whether a player is a preferred player. For example, the number of wager gaming machines that can be involved in concurrent play may depend on a player's level in a player loyalty program. In some such embodiments, a player may be allowed to include 2, 3 or 4 wager gaming machines for concurrent play, depending on the player's level in the player loyalty program.

Some networks described herein provide methods and devices for managing one or more networked gaming establishments. Such networks may sometimes be referred to herein as server-based gaming networks, Sb™ networks, or the like. Some such gaming networks described herein allow for the convenient provisioning of networked gaming machines and other devices relevant to casino operations. Game themes may be easily and conveniently added or changed, if desired. Related software, including but not limited to player tracking software, peripheral software, etc., may be downloaded to networked gaming machines, mobile gaming devices, thin clients and/or other devices, such as kiosks, networked gaming tables, player stations, etc.

In some implementations, servers or other devices of a central system will determine game outcomes and/or provide other wager gaming functionality. In some such implementations, wagering games may be executed primarily on one or more devices of a central system, such as a server, a host computer, etc. For example, wager gaming determinations (such as interim and final game outcomes, bonuses, etc.) may be made by one or more servers or other networked devices. Player tracking functions, accounting functions and even some display-related functions associated with wagering games may be performed, at least in part, by one or more devices of casino network and/or of a central system.

Figure 8:
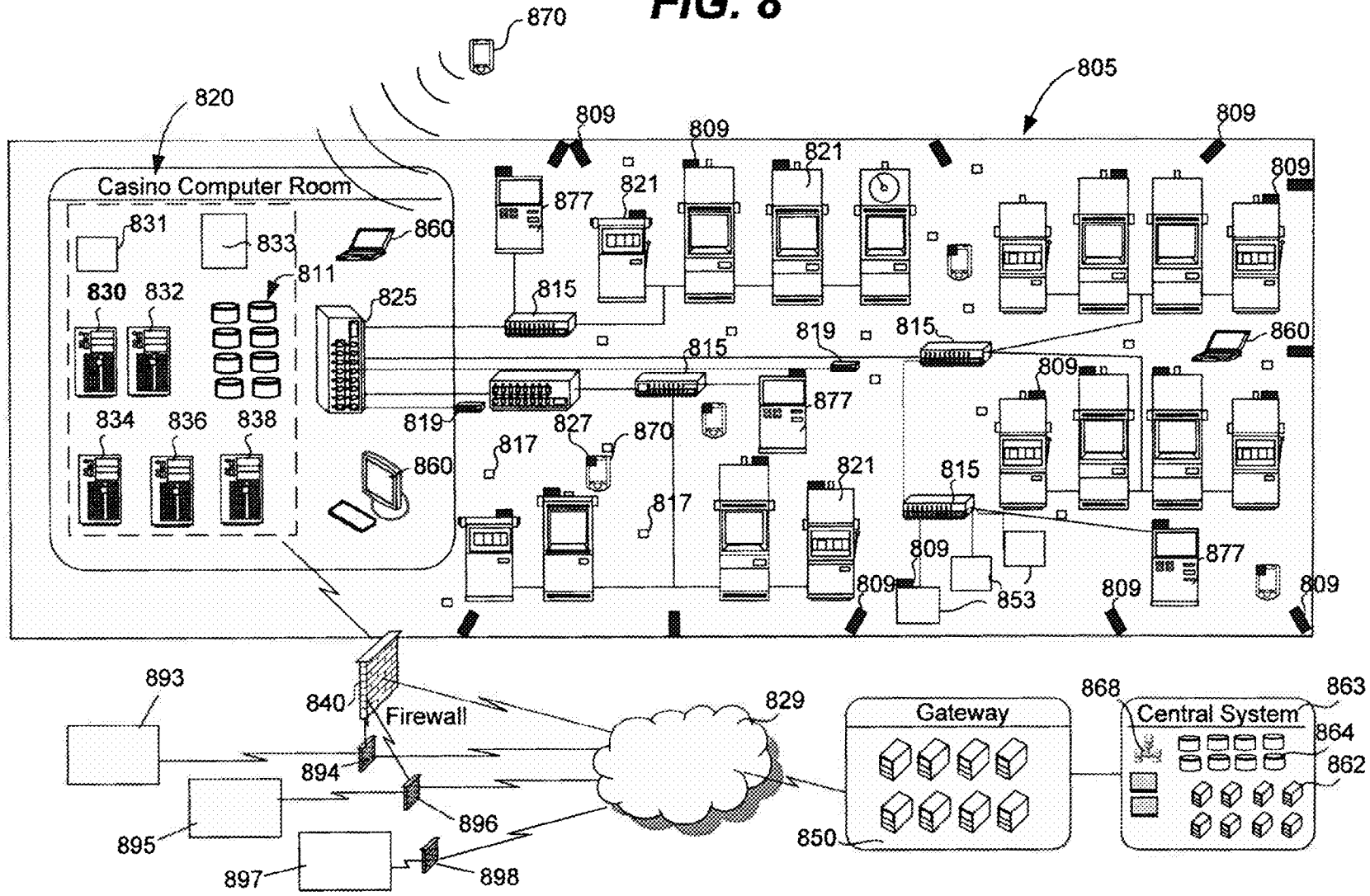
FIG. 8 depicts an example of a gaming establishment and related devices that may be used for some implementations described herein.

One example of an Sb™ network is depicted in FIG. 8. Those of skill in the art will realize that this architecture and the related functionality are merely examples and that the present invention encompasses many other such embodiments and methods.

Here, casino computer room 820 and networked devices of a gaming establishment 805 are illustrated. Gaming establishment 805 is configured for communication with central system 863 via gateway 850. Gaming establishments 893 and 895 are also configured for communication with central system 863.

In some implementations, gaming establishments may be configured for communication with one another. In this example, gaming establishments 893 and 895 are configured for communication with casino computer room 820. Such a configuration may allow devices and/or operators in casino 805 to communicate with and/or control devices in other casinos. In some such implementations, a server in computer room 820 may control devices in casino 805 and devices in other gaming establishments. Conversely, devices and/or operators in another gaming establishment may communicate with and/or control devices in casino 805.

For example, a server of casino 805 or central system 863 may be provisioned with relatively more advanced software (e.g., 3-D facial recognition software) for patron identification than servers of other networked locations. Such a server may process patron identification requests from devices in casino 805 as well as patron identification requests from devices in gaming establishments 893 and 895.

Here, gaming establishment 897 is configured for communication with central system 863, but is not configured for communication with other gaming establishments. Some gaming establishments (not shown) may not be in communication with other gaming establishments or with a central system. Gaming establishment 805 includes multiple gaming machines 821, each of which is part of a bank 810 of gaming machines 821. In this example, gaming establishment 805 also includes a bank of networked gaming tables 853. However, the present invention may be implemented in gaming establishments having any number of gaming machines, gaming tables, etc. It will be appreciated that many gaming establishments include hundreds or even thousands of gaming machines 821 and/or gaming tables 853, not all of which are necessarily included in a bank and some of which may not be connected to a network. At least some of gaming machines 821 and/or mobile devices 870 may be "thin clients" that are configured to perform client-side methods as described elsewhere herein.

Some gaming networks provide features for gaming tables that are similar to those provided for gaming machines, including but not limited to bonusing, player loyalty/player tracking and the use of cashless instruments. Relevant material is provided in U.S. patent application Ser. No. 11/154,833, entitled "CASHLESS INSTRUMENT BASED TABLE GAME PROMOTIONAL SYSTEM AND METHODOLOGY" and filed on Jun. 15, 2005, U.S. Provisional Patent Application No. 60/858,046, entitled "AUTOMATED PLAYER DATA COLLECTION SYSTEM FOR TABLE GAME ENVIRONMENTS" and filed on Nov. 10, 2006, U.S. patent application Ser. No. 11/129,702, entitled "WIDE AREA TABLE GAMING MONITOR AND CONTROL SYSTEM" and filed on May 15, 2005, U.S. patent application Ser. No. 11/425,998 entitled "PROGRESSIVE TABLE GAME BONUSING SYSTEMS AND METHODS", filed Jun. 22, 2006 and U.S. patent application Ser. No. 11/225,299, entitled "UNIVERSAL CASINO BONUSING SYSTEMS AND METHODS" and filed on Sep. 12, 2005, all of which are incorporated herein by reference. Accordingly, software related to such features may be provided and/or controlled, and related data may be obtained and/or provided, according to the present invention.

Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 853 may be configured for communication with individual player terminals (not shown), which may be configured to accept bets, present an electronic representation of a dealer, indicate game outcomes, etc.

Some gaming networks include electronically configurable tables for playing table games. U.S. patent application Ser. No. 11/517,861, entitled "CASINO DISPLAY METHODS AND DEVICES" and filed on Sep. 7, 2006, describes some such tables and is hereby incorporated by reference. An operator may select a desired game, such as a poker game or a blackjack game, and the table will be automatically configured with geometrical patterns, text, etc., which are appropriate for the desired table game. The desired type of table game may be selected by a control on the table itself or according to instructions received from, e.g., a server or a casino manager via a network interface.

Gaming establishment 805 also includes networked kiosks 877. Depending on the implementation, kiosks 877 may be used for various purposes, including but not limited to cashing out, prize redemption, redeeming points from a player loyalty program, redeeming "cashless" indicia such as bonus tickets, smart cards, etc. In some implementations, kiosks 877 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present invention. For example, in some implementations of the invention, kiosks 877 may be configured to receive information from a patron, e.g., by presenting graphical user interfaces.

In this example, each bank 810 has a corresponding switch 815, which may be a conventional bank switch in some implementations. Each switch 815 is configured for communication with one or more devices in computer room 820 via main network device 825, which combines switching and routing functionality in this example. Although various communication protocols may be used, some preferred implementations use the Gaming Standards Association's G2S Message Protocol. Other implementations may use IGT's open, Ethernet-based SuperSAS® protocol, which IGT makes available for downloading without charge. Still other protocols, including but not limited to Best of Breed ("BOB"), may be used to implement various aspects of the invention. IGT has also developed a gaming-industry-specific transport layer called CASH that rides on top of TCP/IP and offers additional functionality and security.

Here, gaming establishment 805 also includes an RFID network, implemented in part by RFID switches 819 and multiple RFID readers 817. An RFID network may be used, for example, to track objects (such as mobile gaming devices 870, which include RFID tags 827 in this example), patrons, etc., in the vicinity of gaming establishment 805. Some examples of how an RFID network may be used in a gaming establishment are set forth in U.S. patent application Ser. No. 11/655,496, entitled "DYNAMIC CASINO TRACKING AND OPTIMIZATION" and filed on Jan. 19, 2007 and in U.S. patent application Ser. No. 11/599,241, entitled "DOWNLOADING UPON THE OCCURRENCE OF PRE-DETERMINED EVENTS" and filed on Nov. 13, 2006, all of which are hereby incorporated by reference.

As noted elsewhere herein, some implementations of the invention may involve "smart" player loyalty instruments, such as player tracking cards, which include an RFID tag. Accordingly, the location of such RFID-enabled player loyalty instruments may be tracked via the RFID network. In this example, at least some of mobile devices 870 may include an RFID tag 827, which includes encoded identification information for the mobile device 870. Accordingly, the locations of such tagged mobile devices 870 may be tracked via the RFID network in gaming establishment 805. Other location-detection devices and systems, such as the global positioning system ("GPS"), may be used to monitor the location of people and/or devices in the vicinity of gaming establishment 805 or elsewhere.

Various alternative network topologies can be used to implement different aspects of the invention and/or to accommodate varying numbers of networked devices. For example, gaming establishments with large numbers of gaming machines 821 may require multiple instances of some network devices (e.g., of main network device 825, which combines switching and routing functionality in this example) and/or the inclusion of other network devices not shown in FIG. 8. Some implementations of the invention may include one or more middleware servers disposed between kiosks 877, RFID switches 819 and/or bank switches 815 and one or more devices in computer room 820 (e.g., a corresponding server). Such middleware servers can provide various useful functions, including but not limited to the filtering and/or aggregation of data received from switches, from individual gaming machines and from other devices. Some implementations of the invention include load-balancing methods and devices for managing network traffic.

Storage devices 811, Sb™ server 830, License Manager 831, Arbiter 833, servers 832, 834, 836 and 838, host device (s) 860 and main network device 825 are disposed within computer room 820 of gaming establishment 805. In practice, more or fewer devices may be used. Depending on the implementation, some such devices may reside in gaming establishment 805 or elsewhere.

One or more devices in central system 863 may also be configured to perform, at least in part, tasks specific to the present invention. For example, one or more servers 862, arbiter 833, storage devices 864 and/or host devices 860 of central system 863 may be configured to implement the functions described in detail elsewhere herein. These functions may include, but are not limited to, providing functionality for devices such as wager gaming machines 821, mobile devices 870, etc. Such functionality may include, but is not limited to, the implementation of concurrent wager gaming by a player on multiple wager gaming devices, e.g., as described above with reference to FIGS. 1-7. For example, a server may aggregate player loyalty points attributable to multiple wager gaming machines involved in a concurrent wager gaming session and update a single player loyalty account accordingly.

One or more of the servers of computer room 820 may be configured with software for receiving a player's wager gaming notification parameters, determining when a wagering condition corresponds with the wager gaming notification parameters and/or providing a notification to the player when the wagering condition corresponds with the wager gaming notification parameters. Moreover, one or more of the servers may be configured to receive, process and/or provide image data from cameras 809, to provide navigation data to patrons (e.g., to indicate the location of and/or directions to a gaming table, a wager gaming machine, etc., associated with a wager gaming notification), etc.

For example, navigation data (which may include map data, casino layout data, camera image data, etc.) may be provided by one or more of the servers of computer room 820 to mobile devices 870. Some implementations of the present invention include a plurality of networked cameras 809, which may be video cameras, smart cameras, digital still cameras, etc. In some such implementations, such cameras may provide, at least in part, real-time navigation features such as those described in U.S. patent application Ser. No. 12/106,771, entitled "Real-Time Navigation Devices, Systems and Methods," which is incorporated herein by reference.

Other devices that may be deployed in network 805 do not appear in FIG. 8. For example, some gaming networks may include not only various radio frequency identification ("RFID") readers 817, but also RFID switches, middleware servers, etc., some of which are not depicted in FIG. 8. These features may provide various functions. For example, a server (or another device) may determine a location of a mobile device 870 according to the location of an RFID reader that reads an RFID tag 827.

The servers and other devices indicated in FIG. 8 may be configured for communication with other devices in or outside of gaming establishment 805, such as host devices 860, kiosks 877 and/or mobile devices 870, for implementing some methods described elsewhere herein. Servers (or the like) may facilitate communications with such devices, receive and store patron data, provide appropriate responses, etc., as described elsewhere herein.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the invention provide one or more of these servers in the form of blade servers.

Some preferred embodiments of Sb™ server 830 and the other servers shown in FIG. 8 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the invention, many of these devices (including but not limited to License Manager 831, servers 832, 834, 836 and 838, and main network device 825) are mounted in a single rack with Sb™ server 830. Accordingly, many or all such devices will sometimes be referenced in the aggregate as an "Sb™ server." However, in alternative implementations, one or more of these devices is in communication with Sb™ server 830 and/or other devices of the network but located elsewhere. For example, some of the devices could be mounted in separate racks within computer room 820 or located elsewhere on the network. Moreover, it can be advantageous to store large volumes of data elsewhere via a storage area network ("SAN").

Computer room 820 may include one or more operator consoles or other host devices that are configured for communication with other devices within and outside of computer room 820. Such host devices may be provided with software, hardware and/or firmware for implementing various aspects of the invention. However, such host devices need not be located within computer room 820. Wired host devices 860 (which are desktop and laptop computers in this example) and wireless devices 870 (which are PDAs in this example) may be located elsewhere in gaming establishment 805 or at a remote location.

Some embodiments of the invention include devices for implementing access control, security and/or other functions relating to the communication between different devices on the network. In this example, arbiter 833 serves as an intermediary between different devices on the network. Arbiter 833 may be implemented, for example, via software that is running on a server or another networked device. Some implementations of Arbiter 833 are described in U.S. patent application Ser. No. 10/948,387, entitled "METHODS AND APPARATUS FOR NEGOTIATING COMMUNICATIONS WITHIN A GAMING NETWORK" and filed Sep. 23, 2004 (the "Arbiter Application"), which is incorporated herein by reference and for all purposes. In some preferred implementations, Arbiter 833 is a repository for the configuration information required for communication between devices on the gaming network (and, in some implementations, devices outside the gaming network). Although Arbiter 833 can be implemented in various ways, one exemplary implementation is discussed in the following paragraphs.

Figure 9:
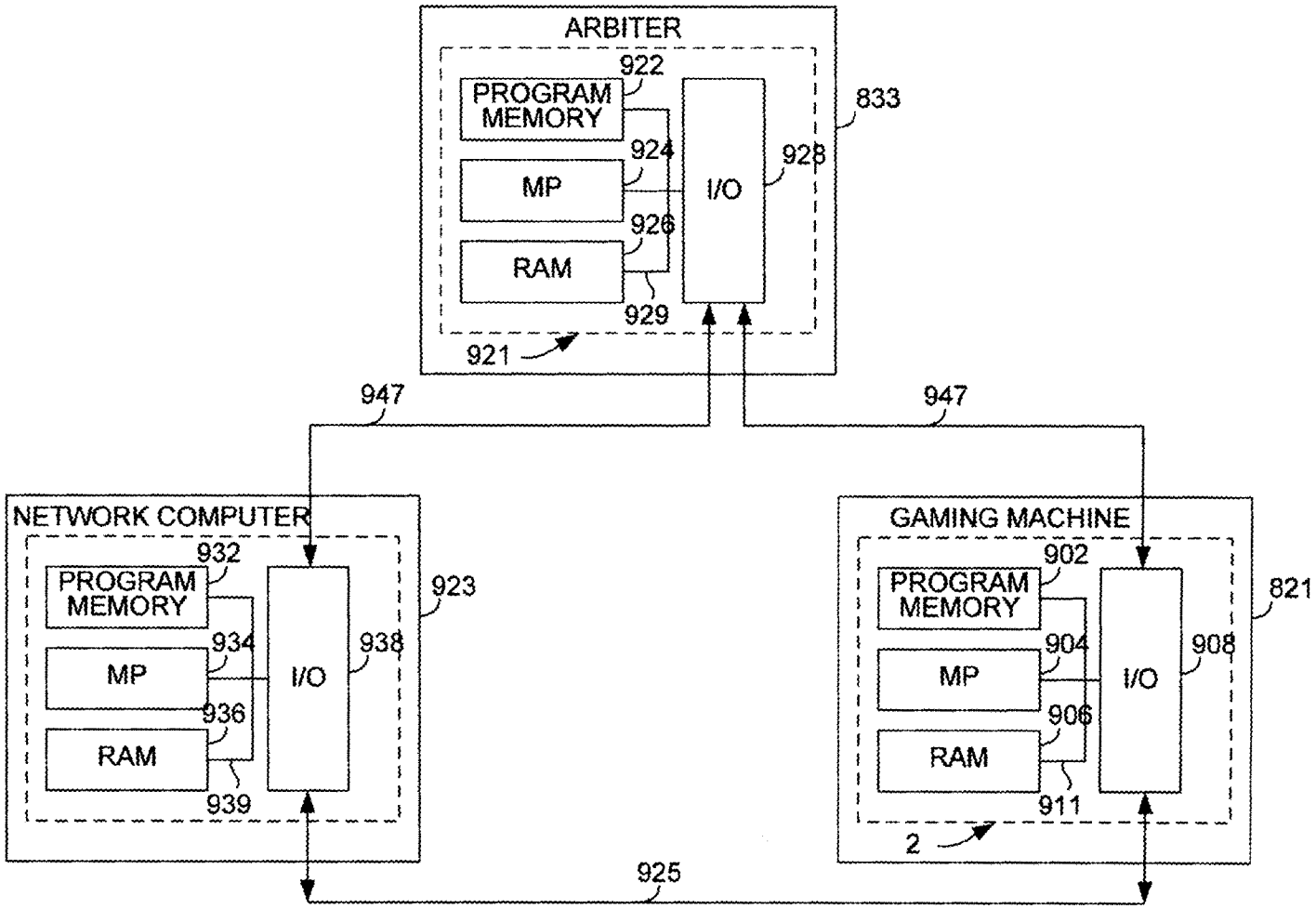
FIG. 9 illustrates an example of an arbiter and related devices that may be used for some implementations described herein.

FIG. 9 is a block diagram of a simplified communication topology between gaming machine 821, network computer 923 and Arbiter 833. Network computer 923 may be, for example, a server or other device within computer room 820 or elsewhere. Although only one gaming machine 821, one network computer 923 and one Arbiter 833 are shown in FIG. 9, it should be understood that the following examples may be applicable to different types of networked devices in addition to gaming machine 821 and network computer 923, and may include different numbers of network computers 923, Arbiters 833 and gaming machines 821. For example, a single Arbiter 833 may be used for secure communications among a plurality of network computers 923 and tens, hundreds or thousands of gaming machines 821. Likewise, multiple Arbiters 833 may be utilized for improved performance and other scalability factors.

Referring to FIG. 9, the Arbiter 833 may include an arbiter controller 921 that may comprise a program memory 922, a microcontroller or microprocessor (MP) 924, a random-access memory (RAM) 926 and an input/output (I/O) circuit 928, all of which may be interconnected via an address/data bus 929. The network computer 923 may also include a controller 931 that may comprise a program memory 932, a microcontroller or microprocessor (MP) 934, a random-access memory (RAM) 936 and an input/output (I/O) circuit 938, all of which may be interconnected via an address/data bus 939. It should be appreciated that although the Arbiter 833 and the network computer 923 are each shown with only one microprocessor 924, 934, the controllers 921, 931 may each include multiple microprocessors 924, 934. Similarly, the memory of the controllers 921, 931 may include multiple RAMs 926, 936 and multiple program memories 922, 932. Although the I/O circuits 928, 938 are each shown as a single block, it should be appreciated that the I/O circuits 928, 938 may include a number of different types of I/O circuits. The RAMs 924, 934 and program memories 922, 932 may be implemented as semiconductor memories, magnetically readable memories, and/or optically readable memories, for example.

Although the program memories 922, 932 are shown in FIG. 9 as read-only memories (ROM) 922, 932, the program memories of the controllers 921, 931 may be a read/write or alterable memory, such as a hard disk. In the event a hard disk is used as a program memory, the address/data buses 929, 939 shown schematically in FIG. 9 may each comprise multiple address/data buses, which may be of different types, and there may be an I/O circuit disposed between the address/data buses.

As shown in FIG. 9, the gaming machine 821 may be operatively coupled to the network computer 923 via the data link 925. The gaming machine 821 may also be operatively coupled to the Arbiter 833 via the data link 949, and the network computer 923 may likewise be operatively coupled to the Arbiter 833 via the data link 947.

Communications between the gaming machine 821 and the network computer 923 may involve different information types of varying levels of sensitivity resulting in varying levels of encryption techniques depending on the sensitivity of the information. For example, communications such as drink orders and statistical information may be considered less sensitive. A drink order or statistical information may remain encrypted, although with moderately secure encryption techniques, such as RC4, resulting in less processing power and less time for encryption. On the other hand, financial information (e.g., account information, winnings, etc.), download information (e.g., game and/or peripheral software, licensing information, etc.) and personal information (e.g., social security number, personal preferences, etc.) may be encrypted with stronger encryption techniques such as DES or 3DES to provide increased security.

As disclosed in further detail in the Arbiter Application, the Arbiter 833 may verify the authenticity of devices in the gaming network, including but not limited to devices sending queries and/or remote procedure calls to gaming machines. The Arbiter 833 may receive a request for a communication session from a network device. For ease of explanation, the requesting network device may be referred to as the client, and the requested network device may be referred to as the host. The client may be any device on the network and the request may be for a communication session with any other network device. The client may specify the host, or the gaming security arbiter may select the host based on the request and based on information about the client and potential hosts. The Arbiter 833 may provide encryption keys (session keys) for the communication session to the client via the secure communication channel. Either the host and/or the session key may be provided in response to the request, or may have been previously provided. The client may contact the host to initiate the communication session. The host may then contact the Arbiter 833 to determine the authenticity of the client. The Arbiter 833 may provide affirmation (or lack thereof) of the authenticity of the client to the host and provide a corresponding session key, in response to which the network devices may initiate the communication session directly with each other using the session keys to encrypt and decrypt messages.

Alternatively, upon receiving a request for a communication session, the Arbiter 833 may contact the host regarding the request and provide corresponding session keys to both the client and the host. The Arbiter 833 may then initiate either the client or the host to begin their communication session. In turn, the client and host may begin the communication session directly with each other using the session keys to encrypt and decrypt messages. An additional explanation of the communication request, communication response and key distribution is provided in the Arbiter Application.

Referring again to FIG. 8, the communication link(s) between casino 805 and central system 863 preferably have ample bandwidth and may, for example, comprise one or more T1 or T3 connections and/or satellite links having comparable bandwidth, etc. Network 829 is the Internet in this example. However, it will be understood by those of skill in the art that network 829 could include any one of various types of networks, such as the public switched telephone network ("PSTN"), a satellite network, a wireless network, a metro optical transport, etc. Accordingly, a variety of protocols may be used for communication on network 829, such as Internet Protocol ("IP"), Fibre Channel ("FC"), FC over IP ("FCIP"), Internet SCSI ("iSCSI," an IP-based standard for linking data storage devices over a network and transferring data by carrying SCSI commands over IP networks) or Dense Wavelength Division Multiplexing ("DWDM," an optical technology used to increase bandwidth over existing fiber optic backbones).

If a host device is located in a remote location, security methods and devices (such as firewalls, authentication and/or encryption) should be deployed in order to prevent the unauthorized access of the gaming network.

Similarly, any other connection between gaming network 805 and the outside world should only be made with trusted devices via a secure link, e.g., via a virtual private network ("VPN") tunnel. For example, the illustrated connection between Sb™ server 830, gateway 850 and central system 863 (that may be used for communications involving peripheral device software downloads, etc.) is advantageously made via a VPN tunnel. Details of VPN methods that may be used with the present invention are described in the reference, "Virtual Private Networks-Technologies and Solutions," by R. Yueh and T. Strayer, Addison-Wesley, 2001, ISBN#0-201-70209-6, which is incorporated herein by reference and for all purposes. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols, including RFC reports, may be obtained from the VPN Consortium, an industry trade group (http://www.vpnc.com, VPNC, Santa Cruz, Calif.).

Alternatively, a permanent virtual circuit ("PVC") can be established to provide a dedicated and secure circuit link between two facilities, e.g., between a casino and central system 863. A PVC is a virtual circuit established for repeated use between the same data terminals. A PVC could be provided, for example, via AT&T's Asynchronous Transfer Mode ("ATM") switching fabric. Some implementations provide a dedicated line from an endpoint (e.g., from casino 805) into the ATM backbone. Other implementations provide a connection over another network (e.g., the Internet) between an endpoint and the nearest device of the ATM backbone, e.g., to the nearest edge router. In some such implementations, the fixed-sized cells used in the ATM switching fabric may be encapsulated in variable sized packets (such as Internet Protocol or Ethernet packets) for transmission to and from the ATM backbone.

For security purposes, information transmitted to, on or from a gaming establishment may be encrypted. In one implementation, the information may be symmetrically encrypted using a symmetric encryption key, where the symmetric encryption key is asymmetrically encrypted using a private key. The public key may, for example, be obtained from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. A different symmetric encryption key is used for each transaction where the key is randomly generated. Symmetric encryption and decryption is preferably applied to most information because symmetric encryption algorithms tend to be 100-10,000 faster than asymmetric encryption algorithms.

Some network implementations may use Trusted Network Connect ("TNC"), which is an open architecture provided by the Trusted Network Connect Sub Group ("TNC-SG") of the Trusted Computing Group (TCG). TNC enables network operators to provide endpoint integrity at every network connection, thus enabling interoperability among multi-vendor network endpoints. Alternatively, or additionally, the Secure Internet File Transfer ("SIFT") may be employed. SIFT allows devices to send and receive data over the Internet in a secure (128-bit encryption) method of transport.

Providing secure connections between devices in a gaming network, such as the connections between the local devices of the gaming network 805 and central system 863, allows for the deployment of many advantageous features. For example, a customer (e.g., an employee of a gaming establishment) may be able to log onto an account of central system 863 to obtain the account information such as the customer's current and prior account status. Automatic updates of a customer's software may also be enabled. For example, central system 863 may notify one or more devices in gaming establishment 805 regarding new products and/or product updates. For example, central system 863 may notify server (or other device) in computer room 820 regarding new software, software updates, the status of current software licenses, etc. Alternatively, such updates could be automatically provided to a server in computer room 820 and downloaded to networked gaming machines.

After the local server receives this information, relevant products of interest may be identified (by the server, by another device or by a human being). If an update or a new software product is desired, it can be downloaded from the central system. Similarly, a customer may choose to renew a software license via a secure connection with central system 863, e.g., in response to a notification that the software license is required.

In addition, providing secure connections between different gaming establishments can enable alternative implementations of the invention. For example, a number of gaming establishments may be owned and/or controlled by the same entity. In such situations, having secure communications between gaming establishments makes it possible for a gaming entity to use one or more servers in a gaming establishment as an interface between central system 863 and gaming machines in multiple gaming establishments. For example, new or updated software may be obtained by a server in one gaming establishment and distributed to gaming machines in that gaming establishment and/or other gaming establishments. A server in one gaming establishment may perform services, such as patron identification services, in response to a request from a device in another gaming establishment.

Figure 10:
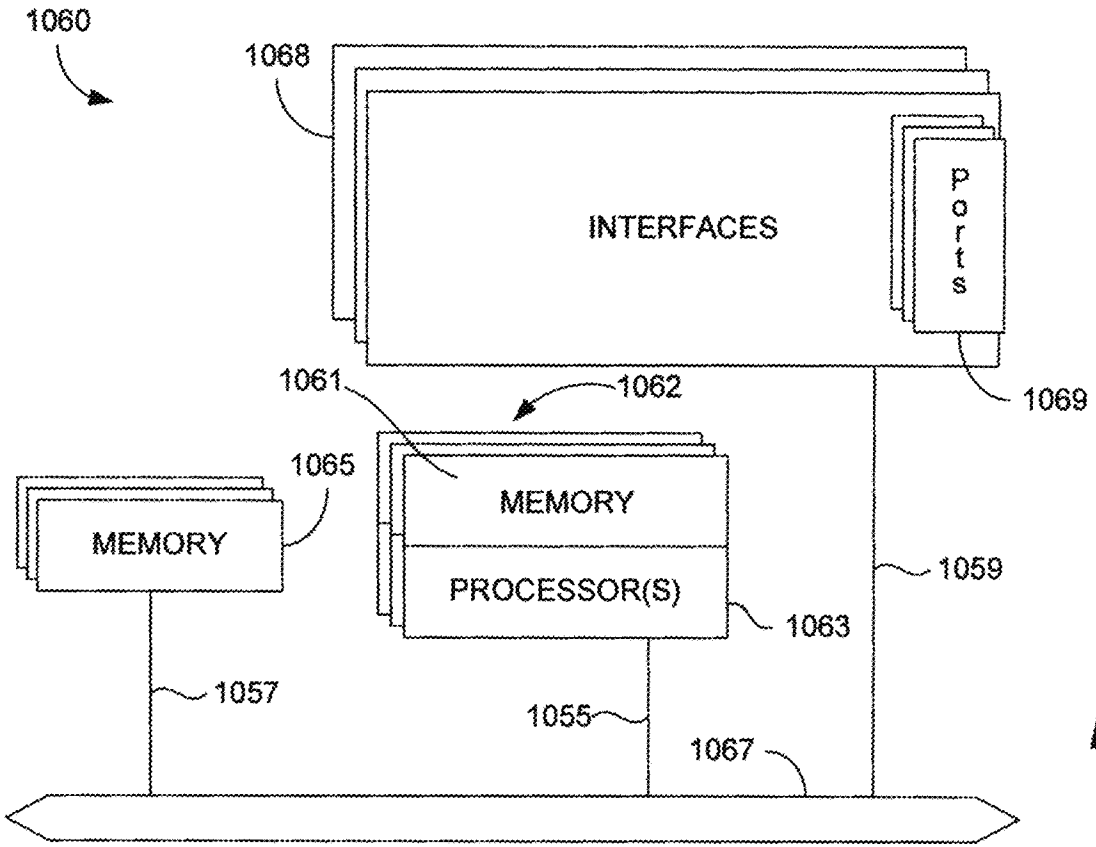
FIG. 10 depicts a network device that may be used for some implementations described herein.

FIG. 10 illustrates an example of a network device that may be configured for implementing some methods of the present invention. Network device 1060 includes a master central processing unit (CPU) 1062, interfaces 1068, and a bus 1067 (e.g., a PCI bus). Generally, interfaces 1068 include ports 1069 appropriate for communication with the appropriate media. In some embodiments, one or more of interfaces 1068 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1068 control such communications-intensive tasks as encryption, decryption, compression, decompression, packetization, media control and management. By providing separate processors for the communications-intensive tasks, interfaces 1068 allow the master microprocessor 1062 efficiently to perform other functions such as routing computations, network diagnostics, security functions, etc.

The interfaces 1068 are typically provided as interface cards (sometimes referred to as "linecards"). Generally, interfaces 1068 control the sending and receiving of data packets over the network and sometimes support other peripherals used with the network device 1060. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1062 may be responsible for implementing specific functions associated with the functions of a desired network device. According to some embodiments, CPU 1062 accomplishes all these functions under the control of software including an operating system and any appropriate applications software.

CPU 1062 may include one or more processors 1063 such as a processor from the Motorola family of microprocessors or the MIPS family of microprocessors. In an alternative embodiment, processor 1063 is specially designed hardware for controlling the operations of network device 1060. In a specific embodiment, a memory 1061 (such as non-volatile RAM and/or ROM) also forms part of CPU 1062. However, there are many different ways in which memory could be coupled to the system. Memory block 1061 may be used for a variety of purposes such as, for example, caching and/or storing data, programming instructions, etc.

Regardless of network device's configuration, it may employ one or more memories or memory modules (such as, for example, memory block 1065) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 10 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 10) or switch fabric based (such as a cross-bar).

The above-described devices and materials will be familiar to those of skill in the gaming industry and/or in the computer hardware and software arts. Although many of the components and processes are described above in the singular for convenience, it will be appreciated by one of skill in the art that multiple components and repeated processes can also be used to practice the techniques of the present invention.

Although illustrative embodiments and applications of this invention are shown and described herein, many variations and modifications are possible which remain within the concept, scope, and spirit of the invention, and these variations should become clear after perusal of this application. For example, while much of the discussion herein involves wager gaming involving stationary wager gaming machines, some aspects of the present invention may be applied to gaming that involves of other types of devices, e.g., one or more mobile gaming devices. Moreover, some aspects of the present invention are not limited to wager gaming, but may instead be applied generally to various other types of gaming. Accordingly, the present embodiments are to be considered as illustrative and not restrictive, and the invention is not to be limited to the details given herein, but may be modified within the scope and equivalents of the appended claims.

I claim:

1. A wager gaming machine comprising:

an interface system;

a user input system configured to receive a selection to use at least one additional wager gaming machine during a wager gaming session; and a logic system configured to:

send a command responsive to the selection, via the interface system, to cause functionality of each of the at least one additional wager gaming machine to be at least partially disabled, such that each of the at least one additional gaming machine is automatically caused to display a visual indication that said additional wager gaming machine is not available for use;

determine a wagering rate for the player based on wager information received via the user input system, said wagering rate based on an amount of wagers placed on each of the wager gaming machines during the wager gaming session relative to a quantity of wager gaming machines used during the wager gaming session; and if the wagering rate falls below a predetermined level, at least partially disable use of the at least one additional wager gaming machine by the player.

2. The wager gaming machine of claim 1, wherein the selection includes at least one identified additional wager gaming machine and wherein the command is to cause functionality of the identified additional wager gaming machine to be at least partially disabled.

3. The wager gaming machine of claim 1, wherein the logic system is configured to provide the wager gaming session by coordinating responses of each of the wager gaming machines.

4. The wager gaming machine of claim 3, wherein the logic system is configured to combine a first wager gaming outcome of the wager gaming machine with at least one additional wager gaming outcome of the at least one additional wager gaming machine to produce a combined wager gaming outcome.

5. The wager gaming machine of claim 4, wherein the combined wager gaming outcome could not be produced in its entirety by any of the wager gaming machines.

6. The wager gaming machine of claim 4, wherein the logic system is configured to evaluate the combined wager gaming outcome by reference to a combined wager gaming outcome paytable that includes at least one combined wager gaming outcome that could not be entirely produced by any individual one of the wager gaming machines.

7. The wager gaming machine of claim 3, wherein the logic system is configured to control a time interval between at least one first image of a first game outcome displayed on the wager gaming machine and at least one additional image of at least one additional game outcome displayed on the at least one additional wager gaming machine.

8. The wager gaming machine of claim 1, wherein the command includes disabling at least a portion of at least one of: a user input system, a player tracking system and an indicia of credit receiving device on the at least one additional wager gaming machine.

9. The wager gaming machine of claim 1, wherein the command includes disabling at least a portion of gaming controller functionality of the at least one additional wager gaming machine.

10. The wager gaming machine of claim 1, wherein the logic system is configured to control, at least in part, an operation of the at least one additional wager gaming machine.

11. The wager gaming machine of claim 1, wherein the user input system is configured to receive a plurality of instructions relating to the at least one additional wager gaming machine.

12. The wager gaming machine of claim 1, wherein the user input system includes a display device configured to display, under control of the logic system, a graphical user interface configured to receive a plurality of instructions regarding the at least one additional wager gaming machine.

13. The wager gaming machine of claim 1, wherein the interface system includes a network interface.

14. The wager gaming machine of claim 1, wherein the interface system is configured to communicate with the at least one additional wager gaming machine via free space optical communication.

15. The wager gaming machine of claim 1, wherein the interface system is configured to communicate with the at least one additional wager gaming machine via an industrial automation protocol.

16. A method of operating a gaming system, said method comprising:

receiving an indication, via a user interface of a wager gaming machine, to use at least one identified additional wager gaming machine during a gaming session;

sending a command to the at least one identified additional wager gaming machine to disable at least a portion of a functionality of the at least one identified additional wager gaming machine such that the at least one identified additional wager gaming machine automatically displays a visual indication that the at least one identified additional wager gaming machine is not available for use;

for the gaming session, coordinating a plurality of responses of the at least one identified additional wager gaming machine and the wager gaming machine;

determining a wagering rate based on wager information received via the user interface, said wagering rate based on an amount of wagers placed on each of the wager gaming machines during the gaming session relative to a quantity of the wager gaming machines used during the gaming session; and if the wagering rate falls below a predetermined level, at least partially disabling use of the at least one identified additional wager gaming machine by the player.

17. The method of claim 16, wherein the command includes a command to disable at least a portion of a user input system of the at least one identified additional wager gaming machine.

18. The method of claim 16, wherein the command includes a command to disable at least a portion of a player tracking system of the at least one identified additional wager gaming machine.

19. The method of claim 16, wherein the command includes a command to disable an indicia of credit receiving device of the at least one identified additional wager gaming machine.

20. The method of claim 16, wherein the command includes a command to disable at least a portion of gaming controller functionality of the at least one identified additional wager gaming machine.

21. The method of claim 16, which includes coordinating a display of at least one of a plurality of images and a plurality of sounds on the wager gaming machines.

22. The method of claim 21, which includes controlling a time interval between at least one first image displayed on the at least one identified additional wager gaming machine and at least one second image displayed on the wager gaming machine.

23. The method of claim 16, which includes combining player loyalty points for wager gaming on the wager gaming machines.

24. The method of claim 16, which includes combining at least one additional wager gaming outcome on the at least one identified additional wager gaming machine with a wager gaming outcome on the wager gaming machine to produce a combined wager gaming outcome.

25. The method of claim 24, wherein the combined wager gaming outcome could not be entirely produced by any of the wager gaming machines.

26. The method of claim 25, which includes evaluating the combined wager gaming outcome based on a combined wager gaming outcome paytable that includes at least one combined wager gaming outcome that could not be entirely produced any of the wager gaming machines.

27. The method of claim 16, which includes making the at least one identified additional wager gaming machine operate, at least in part, under a control of a server.

28. The method of claim 16, which includes making the at least one identified additional wager gaming machine operate, at least in part, under a control of another wager gaming machine.

29. An apparatus, comprising:

an interface system configured to receive an indication to use a plurality of wager gaming machines during a gaming session, the indication including an identified wager gaming machine; and a logic system configured to:

send a command, via the interface system, to disable at least a portion of a functionality of the identified wager gaming machine such that the identified wager gaming machine is caused to automatically display a visual indication that the identified wager gaming machine is not available for use;

for the gaming session, coordinate a plurality of responses of the identified wager gaming machine and at least one other wager gaming machine; and determine a wagering rate based on wager information received via the interface system, said wagering rate based on an amount of wagers placed on each of the plurality of wager gaming machines during the gaming session relative to a quantity of the plurality of wager gaming machines used during the gaming session; and if the wagering rate falls below a predetermined level, at least partially disable use of the plurality of wager gaming machines by the player.

30. The apparatus of claim 29, wherein the command includes a command to disable at least a portion of at least one of a user input system and a player tracking system of the identified wager gaming machine.

31. The apparatus of claim 29, wherein the command includes a command to disable an indicia of credit receiving device of the identified wager gaming machine.

32. The apparatus of claim 29, wherein the command includes a command to disable at least a portion of gaming controller functionality of the identified wager gaming machine.

33. The apparatus of claim 29, wherein the logic system is configured to at least partially control the identified wager gaming machine.

34. The apparatus of claim 29, wherein the logic system is configured to provide game outcome data to the identified wager gaming machine.

35. The apparatus of claim 29, wherein the logic system is configured to coordinate a display of a plurality of wager game outcome images on the wager gaming machines.

36. The apparatus of claim 35, wherein the logic system is configured to control a time interval between at least one first image displayed on the identified wager gaming machine and at least one second image displayed on a second wager gaming machine.

37. The apparatus of claim 29, wherein the logic system is configured to combine a first wager gaming outcome on the identified wager gaming machine with a second wager gaming outcome on at least one other wager gaming machine to produce a combined wager gaming outcome.

38. The apparatus of claim 37, wherein the combined wager gaming outcome could not be entirely produced any of the wager gaming machines.

39. The apparatus of claim 37, wherein the logic system is configured to evaluate the combined wager gaming outcome based on a combined wager gaming outcome paytable that includes at least one combined wager gaming outcome that could not be entirely produced by any of the wager gaming machines.

40. The apparatus of claim 29, wherein the logic system is configured to combine player loyalty points for the wager gaming machines.

41. The apparatus of claim 29, wherein the interface system includes a network interface.

42. The apparatus of claim 29, wherein the interface system includes a user interface.

43. The apparatus of claim 29, wherein the interface system is configured to communicate via an industrial automation protocol.

44. A wager gaming machine comprising:

an interface system configured to communicate with at least a second wager gaming machine;

a user input system; and a logic system configured to:

receive an indication, via the interface system, to initiate a wager gaming session involving at least the second wager gaming machine;

enable the user input system to operate as at least part of a centralized device set configured to control at least the second wager gaming machine during the wager gaming session;

determine a combined wager gaming outcome based on combining a first wager gaming outcome of the wager gaming machine with at least a second wager gaming outcome of at least the second wager gaming machine;

evaluate the combined wager gaming outcome based on a multi-machine paytable including at least one combined wager gaming outcome that could not be entirely produced by any of the wager gaming machines;

determine a wagering rate based on wager information received via the user input system, said wagering rate based on an amount of wagers placed on each of the wager gaming machines during the gaming session relative to a quantity of the wager gaming machines used during the gaming session; and if the wagering rate falls below a predetermined level, at least partially disable control, via the user input system, of the at least one second wager gaming machine.

45. The wager gaming machine of claim 44, which includes a value input system, wherein the logic system is configured to control the value input system to operate as part of the centralized device set such that indicia of value may be input via the value input system and credited for wager gaming on any of the wager gaming machine and the at least one second wager gaming machine.

46. The wager gaming machine of claim 44, which includes a payout system, wherein the logic system is configured to control the payout system to operate as part of the centralized device set, such that indicia of value may be output via the payout system corresponding to wager gaming on any of the wager gaming machine and the at least one second wager gaming machine.

47. The wager gaming machine of claim 44, which include a player loyalty card reader, wherein the logic system is configured to control the player loyalty card reader to operate as part of the centralized device set such that player loyalty data obtained via the player loyalty card reader may be associated with wager gaming on any of the wager gaming machine and the at least one second wager gaming machine.

48. A wager gaming machine comprising:

an interface system including at least one network interface configured to communicate with at least a second wager gaming machine;

a user input system; and a logic system configured to:

receive an indication, via the interface system, to initiate a wager gaming session involving at least the second wager gaming machine;

provide the gaming session by coordinating events presented on the wager gaming machine and at least the second wager gaming machine, wherein the coordinating includes controlling a time interval between an event presented on the wager gaming machine and a corresponding event presented on at least the second wager gaming machine, wherein the event includes a presentation of at least one of an image and a sound within a first game outcome of the wager gaming machine and the corresponding event includes a presentation of at least one of an image and a sound within a second game outcome of at least the second wager gaming machine; and determine a wagering rate based on wager information received via the user input system, said wagering rate based on an amount of wagers placed on each of the wager gaming machines during the gaming session relative to a quantity of the wager gaming machines used during the gaming session; and if the wagering rate falls below a predetermined level, at least partially disable use of at least the second wager gaming machine.

49. The wager gaming machine of claim 48, wherein the at least one network interface is configured to communicate to at least the second wager gaming machine the timing of the presentation of the corresponding event on at least the second wager gaming machine.

50. The wager gaming machine of claim 48, wherein the event is presented on the wager gaming machine and the corresponding event is presented on at least the second wager gaming machine simultaneously.

51. The wager gaming machine of claim 48, wherein the event and the corresponding event are presented simultaneously.

52. The wager gaming machine of claim 48, wherein the event and the corresponding event are presented sequentially.

53. The wager gaming machine of claim 48, wherein the logic system is configured to send a command to disable at least a portion of the functionality of at least the second wager gaming machine.

* * * * *